US009417587B2

(12) United States Patent
Taira

(10) Patent No.: US 9,417,587 B2
(45) Date of Patent: Aug. 16, 2016

(54) IMAGE FORMING APPARATUS HAVING BELT UNIT

(71) Applicant: Brother Kogyo Kabushiki Kaisha, Nagoya (JP)

(72) Inventor: Kazuya Taira, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/668,067

(22) Filed: Mar. 25, 2015

(65) Prior Publication Data

US 2015/0277332 A1 Oct. 1, 2015

(30) Foreign Application Priority Data

Mar. 31, 2014 (JP) ..... 2014-072767
Mar. 31, 2014 (JP) ..... 2014-072768

(51) Int. Cl.
*G03G 15/00* (2006.01)

(52) U.S. Cl.
CPC ..... *G03G 15/6529* (2013.01)

(58) Field of Classification Search
CPC ..... B65H 2404/256
USPC ..... 399/164
See application file for complete search history.

(56) References Cited

U.S. PATENT DOCUMENTS 4,298,277 A * 11/1981 Silverberg ..... G03B 27/64 226/95
5,258,816 A * 11/1993 Haneda ..... G03G 15/0105 198/814
5,585,892 A * 12/1996 Hayano ..... G03G 15/754 399/164
5,620,084 A * 4/1997 Mensch ..... B65G 17/02 198/834
5,708,924 A * 1/1998 Shogren ..... G03G 15/754 206/303
6,097,922 A * 8/2000 Munenaka ..... G03G 15/0131 399/303
6,871,038 B2 * 3/2005 Fujiwara ..... G03G 15/161 198/840
8,233,823 B2 * 7/2012 Adachi ..... G03G 15/1615 198/840
2002/0046932 A1 4/2002 Wakana

FOREIGN PATENT DOCUMENTS

JP 2002-23518 A 1/2002
JP 2012-163987 A 8/2012

* cited by examiner

*Primary Examiner* — Anthony Nguyen
(74) *Attorney, Agent, or Firm* — Burr & Brown, PLLC

(57) ABSTRACT

A belt unit includes a roller, a belt, a first guide, a second guide and a regulating portion. The first guide is provided on a surface of the roller. The first guide is in a form of one of a convex shape and a concave shape. The belt is looped taut around the rollers, and has a second guide in a form of one of a concave shape and a convex shape. The first guide and the second guide are engaged with each other with an engagement depth in the radial direction. The regulating portion confronts the outer belt surface and provides a gap between the regulating portion and the outer belt surface, the gap being smaller than the engagement depth.

17 Claims, 21 Drawing Sheets

IMAGE FORMING APPARATUS HAVING BELT UNIT

CROSS REFERENCE TO RELATED APPLICATION

This application claims priority from Japanese Patent Applications No. 2014-072767 filed Mar. 31, 2014 and No. 2014-072768 filed Mar. 31, 2014. The entire content of the priority application is incorporated herein by reference.

TECHNICAL FIELD

The present disclosure relates to an image forming apparatus having a mechanism for restraining meandering and deviated running.

BACKGROUND

Among various conventional image forming apparatuses known in the art, one technology discloses an image forming apparatus having a mechanism for restraining meandering and deviated running of a belt such as a sheet conveying belt or an intermediate transfer belt. Specifically, according to the image forming apparatus, an abutting rib provided on an inner surface of the belt is engaged with an annular groove formed at an end portion of a tension roller to which the belt is mounted. Further, the image forming apparatus is provided with a detachable tray for accommodating a process cartridge movably provided, and a roller member provided in the detachable tray. The roller member is adapted to press an outer surface of the belt when the abutting rib is about to be moved onto an outer peripheral surface of the tension roller after the rib is disengaged from the annular groove.

There is known an image forming apparatus having a configuration that prevents meandering and deviated running of a belt such as a sheet conveying belt or an intermediate transfer belt. Specifically, this image forming apparatus has a guide rib provided on an inner surface of the belt, and the guide rib is engaged in a groove formed at an end portion of a roller over which the belt is mounted. Further, this image forming apparatus has a cleaning blade for cleaning the belt applying a uniform pressing force to the entire width of the belt in an axial direction of a roller to prevent the guide rib from separating from the groove and running on an outer peripheral surface of the roller.

SUMMARY

As described above, in the above conventional image forming apparatus, the cleaning blade applies a uniform pressing force to the entire width of the belt in the roller axial direction. Thus, once the belt starts deviating from the roller due to meandering, the deviation may continue. Furthermore, according to the conventional image forming apparatus, when the guide rib disengages from the groove and runs on the outer peripheral surface of the roller, the belt is sandwiched between the cleaning blade and the roller and is continuously applied to a load. Consequently, the belt may be damaged.

In addition, according to the above-described conventional image forming apparatus, the detachable tray provided with the roller member is movable relative to the belt, so that a distance between the roller member and the belt is changed each time the detachable tray is moved. This may cause disengagement of the abutting rib from the annular groove, resulting in failure to prevent meandering and/or deviated running of the belt.

According to one aspect, present specification provides a belt unit and an image forming apparatus capable of restraining meandering and/or deviated running of the belt.

According to one aspect, the belt unit includes a roller, a first guide, a belt, a second guide, and a regulating portion. The roller extends in an axial direction and defines a radial direction perpendicular to the axial direction. The first guide is provided on a surface of the roller. The first guide is in a form of one of a convex shape and a concave shape. The belt is configured to be looped taut around plurality of the rollers. The second guide is provided on an inner belt surface. The second guide is in a form of one of a concave shape and a convex shape. The first guide and the second guide are engaged with each other with an engagement depth in the radial direction. The regulating portion is opposite to an outer belt surface and provides a gap smaller than the engagement depth. The gap is a length between the regulating portion and the outer belt surface.

According to another aspect, the belt unit includes a roller, a first guide, a belt, a second guide, and a regulating portion. The roller extends in an axial direction, defines a radial direction perpendicular to the axial direction, and has a center portion in the axial direction. The first guide is provided on a surface of the roller. The first guide is in a form of a concave shape. The belt is configured to be looped taut around plurality of the rollers. The second guide is in a form of a convex shape configured to engage with the first guide with an engagement depth in the radial direction. The belt has a center belt portion in the axial direction. The regulating portion is opposite to an outer belt surface and has a portion aligned with the first guide in the radial direction. The regulating portion is profiled to provide a gap between the regulating portion and the outer belt surface in the radial direction such that the gap is gradually decreased toward the center belt portion in the axial direction. The gap has a minimum gap length smaller than the engagement depth.

According to another aspect, the belt unit includes a roller, a first guide, a belt, a second guide, and a regulating portion. The roller extends in an axial direction and defines a radial direction perpendicular to the axial direction. The first guide is provided on a surface of the roller and has a concave shape. The belt is configured to be looped taut around plurality of the roller and has a center portion in the axial direction. The second guide is provided at an inner belt surface. The second guide is engaged with the first guide with an engagement depth in the radial direction. The first guide and the second guide provide a first gap therebetween in the radial direction. The first gap is increased toward the center portion in the axial direction. The regulating portion is opposite to an outer belt surface and has a portion aligned with the second guide in the radial direction. The regulating portion provides a second gap between the regulating portion and the outer belt surface. The second gap is smaller than the engagement depth.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
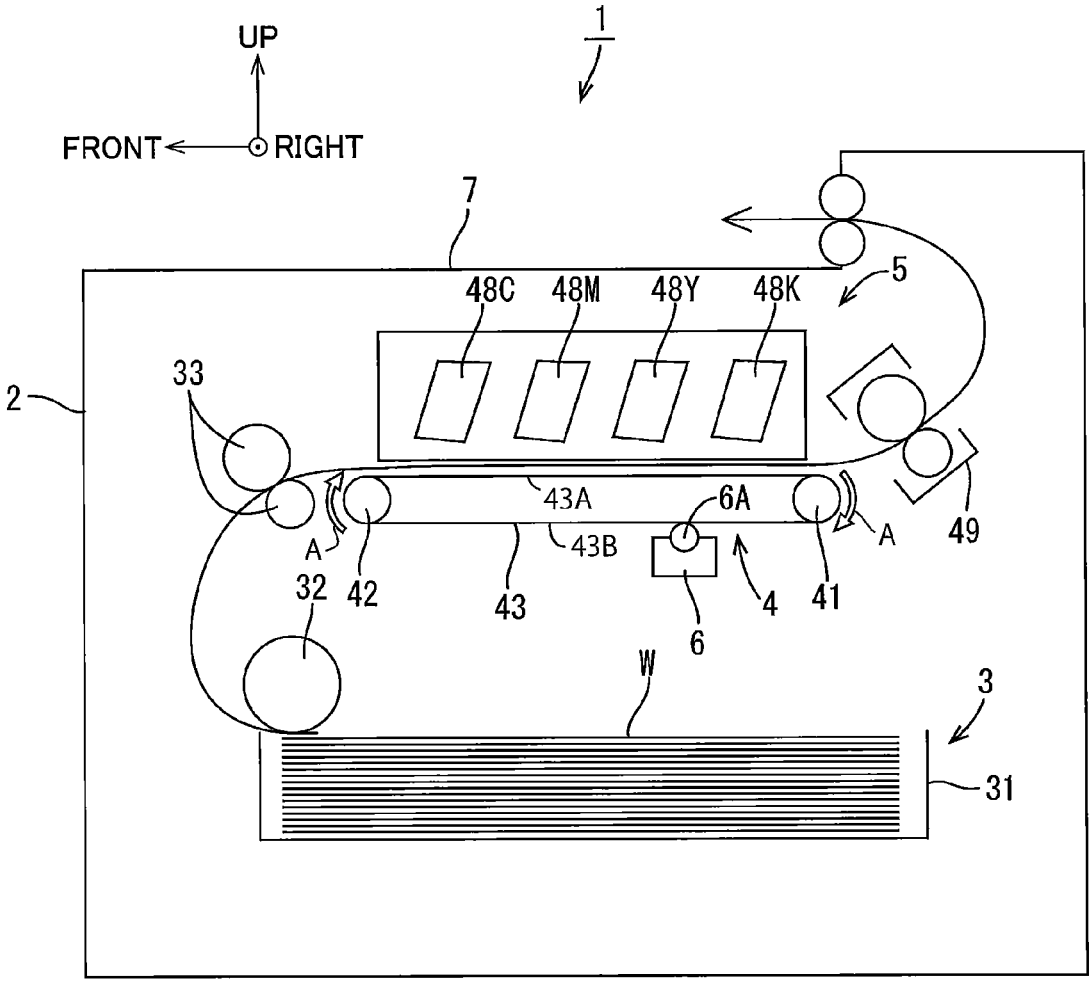
FIG. 1 is a schematic cross-sectional view of a printer.

A printer according to a first embodiment will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the printer is disposed in an orientation in which it is intended to be used. In use, the printer is disposed as shown in FIG. 1.

First Embodiment

A printer 1 as an example of an image forming apparatus according to a first embodiment of the present invention will be described with reference to FIGS. 1 to 4. In the following description, a left side of FIG. 1 is defined as a front side F of the printer 1, a front side of FIG. 1 is defined as a right side R of the printer 1, and an upper side of FIG. 1 is defined as an upper side U of the printer 1.

The printer 1 is a direct transfer tandem type printer that can form a color image using developer or coloring materials (e.g., black, yellow, magenta, and cyan). In the following description, in a case of distinguishing the components of the printer 1 on a basis of color, "K (Black)", "Y (Yellow)", "M (Magenta)", and "C (Cyan)" those indicating the color are added to the reference numerals of the respective components.

The printer 1 includes, in a main casing 2, a sheet delivery section 3, a belt unit 4, an image forming section 5, a cleaner 6, and a discharge tray 7. The sheet delivery section 3 includes a tray 31, a pickup roller 32, and a registration roller 33. The tray 31 is adapted to accommodate a plurality of printing sheets W. The pickup roller 32 is adapted to feed each printing sheet W from the tray 31. The registration roller 33 is adapted to feed the sheet W onto the belt unit 4 while performing skew correction.

The belt unit 4 includes a drive roller 41, a support roller 42, and an endless belt 43 mounted over the drive roller 41 and the support roller 42. An arrow A in each drawing indicates a moving direction of an endless belt 43. When the drive roller 41 is driven by a drive motor (not shown), a belt 43 is moved in a clockwise direction in FIG. 1, causing the sheet W fed onto the belt 43 to be conveyed to a fixing unit 49 described later. The support roller 42 is an example of a roller. Hereinafter, a surface of the belt 43 facing the drive roller 41 and support roller 42 will be referred to as an inner surface, and a surface of the belt 43 opposite to the drive roller 41 and support roller 42 will be referred to as an outer surface. A detailed configuration of the belt unit 4 will be described later.

The image forming section 5 includes four process sections 48K to 48C corresponding to respective colors, and the fixing unit 49. In each process section 48, a photosensitive body (not shown) is subjected to charging and is exposed to light to form an electrostatic latent image. Then, toner is transferred onto the electrostatic latent image, and the toner image is transferred onto the sheet W. The sheet W on which the image has been formed is then thermally fixed by the fixing unit 49 and is discharged onto the discharge tray 7. The cleaner 6 including a cleaning roller 6A is positioned below the belt unit 4. The cleaner is adapted to collects residual toner or paper dust deposited onto a surface of the belt 43. The cleaner 6 is an example of a cleaning unit.

Figure 2:
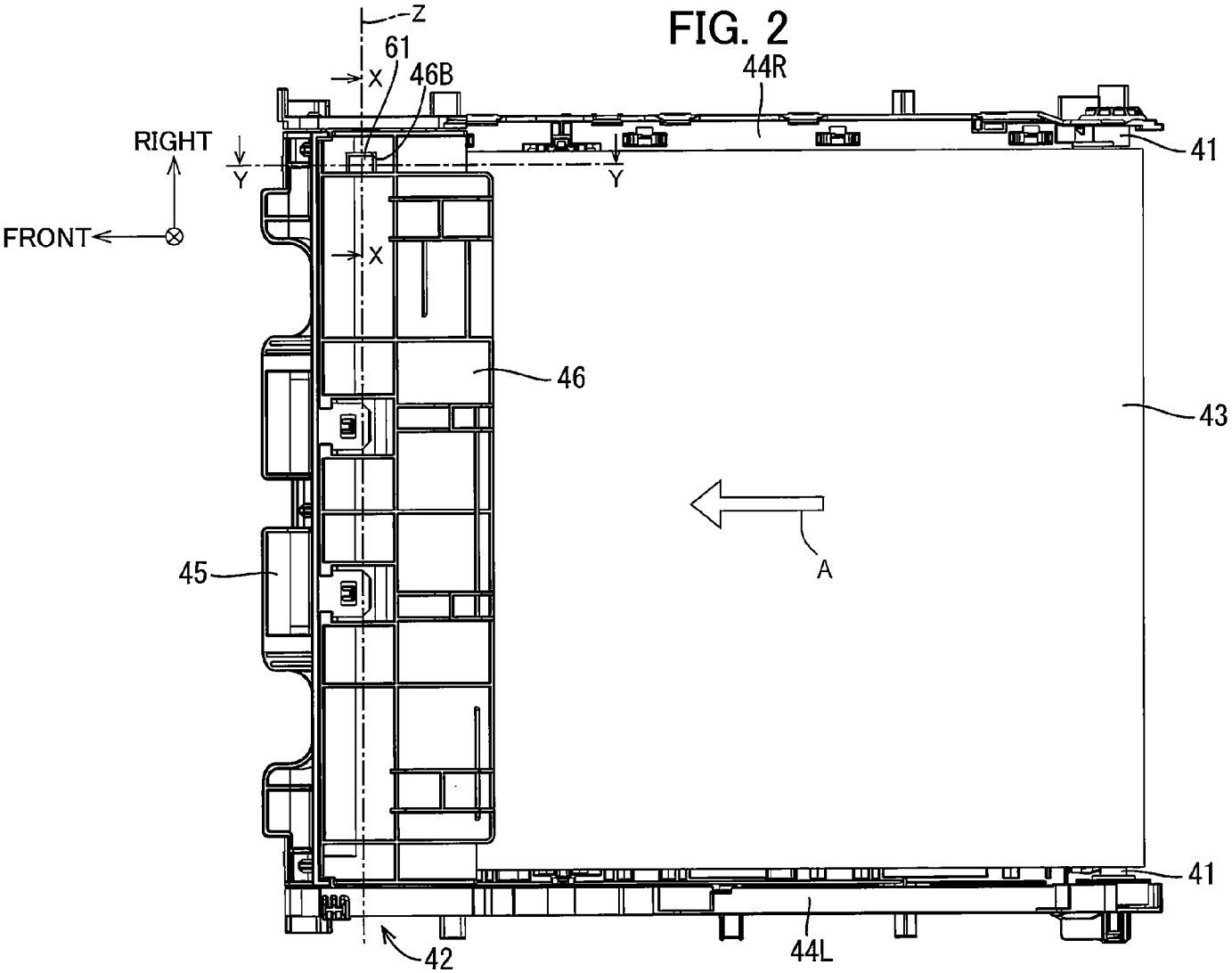
FIG. 2 is a lower view of a belt unit according to a first embodiment.

As illustrated in FIG. 2, the belt unit 4 further includes a pair of side frames 44R and 44L, a connecting portion 45, and a bottom frame 46. Each side frame 44R, 44L has a flat plate-like shape elongated in a sub-scanning direction and is disposed on each lateral side (left side and right side) of the belt 43. The sub-scanning direction corresponds to a frontward/rearward direction of the printer 1.

The support roller 42 extends in a main scanning direction and is supported at each front end portion of each side frame 44R and 44L so as to be rotatable about a rotation axis extending in the main scanning direction. Hereinafter, the rotation axis will be referred to as a roller rotation axis Z. The main scan direction corresponds to the extending direction of the rotation axis of the roller, i.e., leftward/rightward direction of the printer 1. Each side frame 44R and 44L is an example of a bearing portion.

Figure 3:
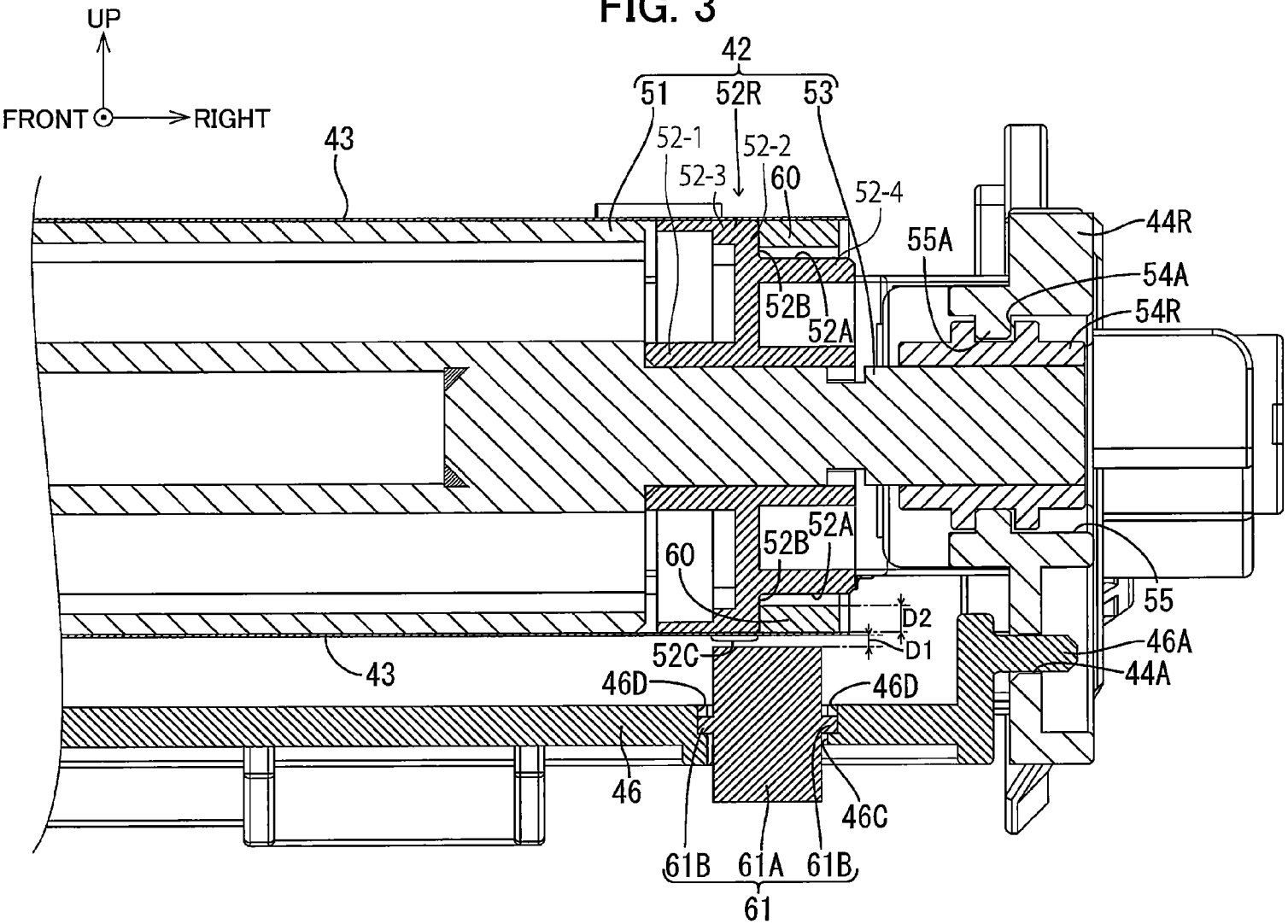
FIG. 3 is a cross-sectional view of the belt unit taken along line X-X of FIG. 2.

Specifically, as illustrated in FIG. 3, the support roller 42 includes a roller body 51, a pair of flange sections 52R and 52L, and a roller shaft body 53, and these members are integrally rotated about the roller rotation axis Z. Note that illustration of the left-side flange 52L is omitted in FIG. 3. The roller body 51 has a hollow cylindrical shape whose axis is coincident with the roller rotation axis Z. Each of the flange sections 52R and 52L has an annular shape whose axis is coincident with the roller rotation axis Z, and is provided on each lateral end (right end and left end) of the roller body 51.

The right flange section 52R has a sleeve portion 52-1 disposed over the roller shaft body 53 and coaxial therewith, a flange 52-2 extending radially outwardly from the sleeve portion 52-1, a large diameter portion 52-3 extending from a radially outer end portion of the flange 52-2 toward the roller body 51 and having an outer diameter equal to that of the roller body 51, and a small diameter portion 52-4 extending from the flange 52-2 in a direction away from the roller body 51 and having an outer diameter smaller than that of the large diameter portion 52-3. An annular stepped guide portion or a guide concave portion 52A is defined by an entire outer peripheral surface of the small diameter portion 52-4 and the flange 52-2. More specifically, a planar surface of the flange section 52R, the surface being opposite to the roller body 51, functions as a stepped surface 52B.

As a modification, instead of the annular stepped guide portion 52A, an annular guide groove is available. For providing the annular guide groove, an annular protrusion protruding radially outwardly from the small diameter portion 52-2 is further provided. The annular stepped guide portion 52A and the annular guide groove are examples of a first guide.

The roller shaft body 53 extends through the roller body 51 and the pair of the flange sections 52R and 52L, and each axial end portion of the roller shaft body 53 protrudes outward from each flange section 52R and 52L. The protruding portions of the roller shaft body 53 are fitted with sleeve members 54R and 54L, respectively. Note that illustration of the left sleeve member 54L is omitted in FIG. 3. An annular bearing groove 54A is formed over an outer peripheral surface of each of the sleeve members 54R and 54L. On the other hand, a bearing hole 55 is formed in each of the side frames 44R and 44L, and an annular bearing protrusion 55A protrudes radially inwardly from an inner peripheral surface of the bearing hole 55. The annular bearing protrusion 55A is engaged with the annular bearing groove 54A, whereby the support roller 42 is rotatably supported by the pair of side frames 44R and 44L while movement of the support roller 42 in leftward/rightward direction is prevented.

A convex-shaped guide rib 60 is formed over an entire periphery of a right end portion of an inner peripheral surface of the belt 43. The guide rib 60 is an example of a second guide. The guide rib 60 is engaged with the annular stepped guide portion 52A of the flange section 52R. With this configuration, even when the belt 43 starts to meander during movement, the guide rib 60 and stepped surface 52B of the annular stepped guide portion 52A abut against each other (in other words, the guide rib 60 and stepped surface of the annular stepped guide portion 52A are engaged with each other) thereby preventing the belt 43 from being deviated in the leftward/rightward direction with respect to the support roller 42. Incidentally, the drive roller 41 is supported at the rear end portions of the pair of the side frames 44R and 44L, respectively, so as to be rotatable about a rotation axis extending in the main scanning direction.

Figure 4:
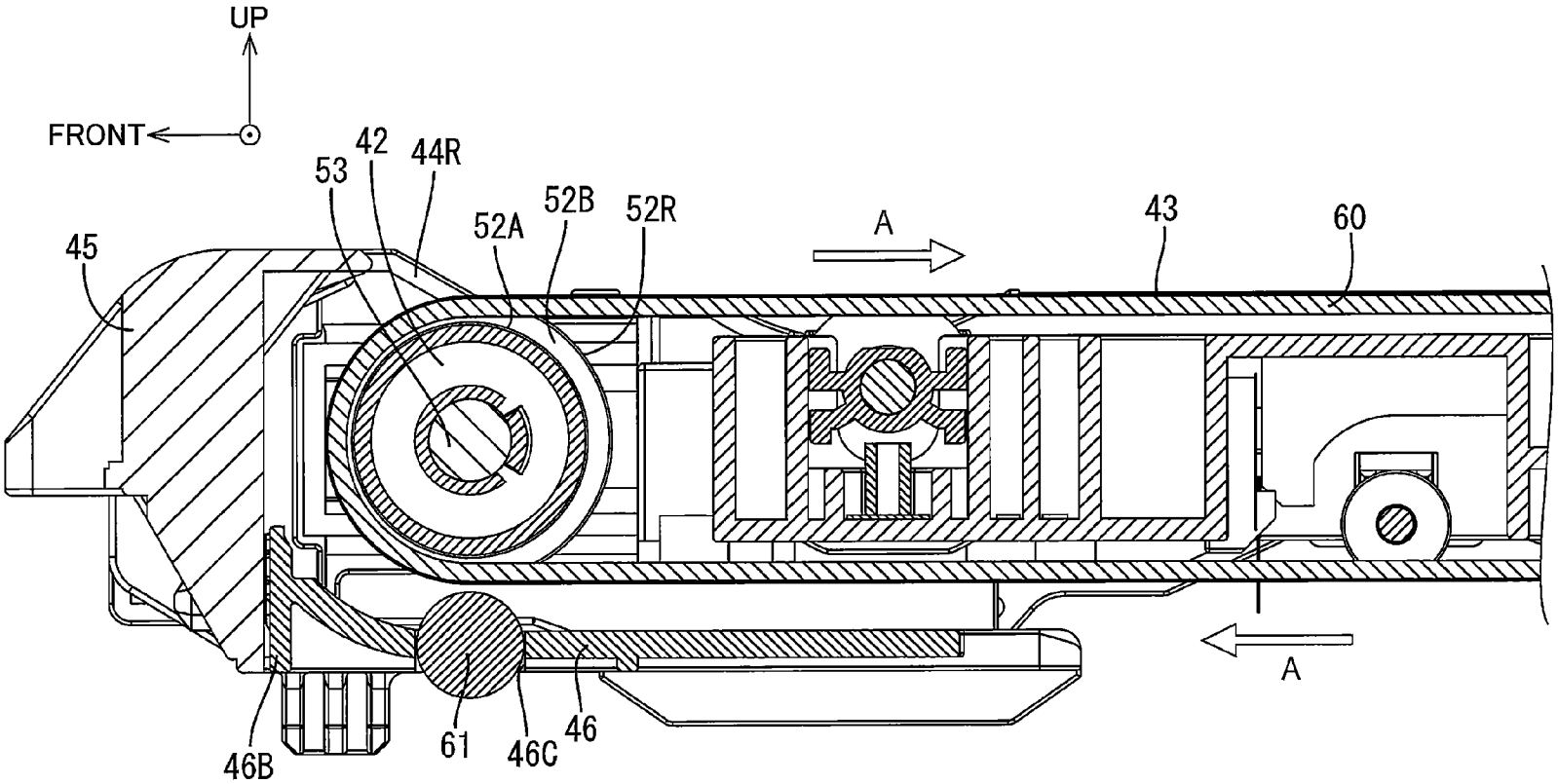
FIG. 4 is a cross-sectional view of the belt unit taken along line Y-Y of FIG. 2.

As shown in FIG. 2, the connecting portion 45 is longer than the belt 43 in the leftward/rightward direction and has each end connected to each front end of each side frames 44R, 44L. As shown in FIGS. 3 and 4, the bottom frame 46 has a flat plate-like shape and is fixed to the pair of the side frames 44R and 44L and the connecting portion 45 so as to cover a lower surface of a front half portion of the belt 43. More specifically, fixing holes 44A are formed in the pair of the side frames 44R and 44L, respectively, and fixing protrusions 46A protrude outward from left and right end faces of the bottom frame 46, respectively. The fixing protrusions 46A are inserted into the corresponding fixing holes 44A.

Further, as illustrated in FIG. 4, a flat plate-like abutting portion 46B is provided at a front end of the bottom frame 46. The abutting portion 46B is in abutment with a rear surface of the connecting portion 45. As a result, the bottom frame 46 is fixed to and integrated with the pair of the side frames 44R and 44L and the connecting portion 45. The bottom frame 46 is provided for avoiding the user's direct access to the belt 43. The bottom frame 46 is an example of a plate.

As illustrated in FIGS. 2 and 3, a rotary body 61 is provided in the bottom frame 46 so as to be rotatable about a rotation axis extending parallel to the roller rotation axis Z. More specifically, a through-hole 46C is formed in the bottom frame 46 at a position below the flange section 52R for positioning the rotary body 61. Incidentally, instead of the through-hole 46C, a recess can be formed at an upper surface of the bottom frame 46 for positioning the rotary body 61. Further, bearings 46D and 46D are formed in left and right inner surfaces of the through-hole 46C.

As illustrated in FIG. 3, the rotary body 61 includes a body 61A and shaft portions 61B and 61B protruding leftward and rightward from the body 61A. The body 61A is a cylindrical roller body whose axis is coincident with the roller rotation axis Z and having a constant diameter over an entire length thereof. The roller body 61A has a length in leftward/rightward direction substantially the same as a width of the guide rib 60. The shaft portions 61B and 61B are rotatably supported by the bearings 46D and 46D, respectively. With this structure, the rotary body 61 is rotated when the belt 43 is circularly moved while contacting with the belt 43. The rotary body 61 is an example of a rotating member. The bottom frame 46 is an example of a support portion. The rotary body 61 and the bottom frame 46 is an example of a regulating portion.

As illustrated in FIG. 3, a gap D1 between an upper surface of the rotary body 61 and outer surface of the belt 43 is smaller than a length D2 over which the guide rib 60 and annular stepped guide portion 52A overlap each other in a radial direction of the support roller 42, i.e., vertical direction in FIG. 3. Thus, even when the guide rib 60 is urged to be separated from the annular stepped guide portion 52A (guide rib 60 comes off the annular stepped guide portion 52A), the outer surface of the belt 43 abuts the rotary body 61, thereby preventing the guide rib 60 from coming off from the annular stepped guide portion 52A.

Further, the rotary body 61 is provided at the bottom frame 46 which is supported by the side frame 44 serving as a bearing portion for bearing a shaft of the support roller 42. Thus, positional relationship and the gap between the outer surface of the belt 43 and the rotary body 61 are less likely to be changed even when the belt unit 4 or the image forming section 5 is moved for replacement, in comparison with a case where the rotary body 61 is provided at a component separated from the belt unit 4 such as the image forming section 5. Thus, coming off of the guide rib 60 from the annular stepped guide portion 52A can be prevented.

Further, the rotary body 61 is positioned so as to align, in the vertical direction, both the guide rib 60 and a portion 52C of the large diameter portion 52-3, the portion 52C being closer to the annular stepped guide portion 52A than a remaining portion of the large diameter portion 52-3 to the annular stepped guide portion 52A in the direction of the roller rotation axis Z. In other words, the rotary body 61 faces the guide rib 60 and the adjacent portion 52C through the belt 43. With this configuration, coming off of the guide rib 60 from the annular stepped guide portion 52A can be prevented more reliably in comparison with a case where the rotary body 61 is vertically aligned with only one of the guide rib 60 and the adjacent portion 52C in the direction of the roller rotation axis Z.

Further, a component in abutment with the outer surface of the belt 43 is the rotary body 61. Thus, damage to the belt 43 due to the abutment can be effectively restrained in comparison with a case where a stationary non-rotatable member abuts against the outer surface of the belt 43.

Further, as described above, the rotary body 61 is rotated when being brought into contact with the belt 43 in a state where the rotary body 61 is positioned at the through-hole 46C of the bottom frame 46. Thus, in comparison with a configuration shown in FIG. 7 in which the rotary body is not positioned in the through-hole or recess but is positioned outside of the bottom frame, the rotary body 61 having an enlarged diameter can be used under the condition that the gap D1 between the bottom frame 46 and outer surface of the belt 43 in FIG. 3 is equal to that in FIG. 7. Therefore, in the first embodiment, a contacting area of the rotary body 61 relative to the belt 43 can be increased to lower a pressing force of the rotary body 61 against the belt 43, thereby preventing damage to the belt 43.

Further, the rotary body 61 is provided on the outer surface side of a part of the belt 43, the part not ranging from the image forming section 5 to the cleaner 6 but ranging from the cleaner 6 to the image forming section 5. In other words, the roller body 51 contacts the belt 43 that has been cleaned by the cleaner 6. This can prevent the rotary body 61 from being contaminated by coloring materials adhered to the belt 43 and prevent the coloring materials on the contaminated rotary body 61 from being transferred back to the belt 43.

Second Embodiment

Figure 5:
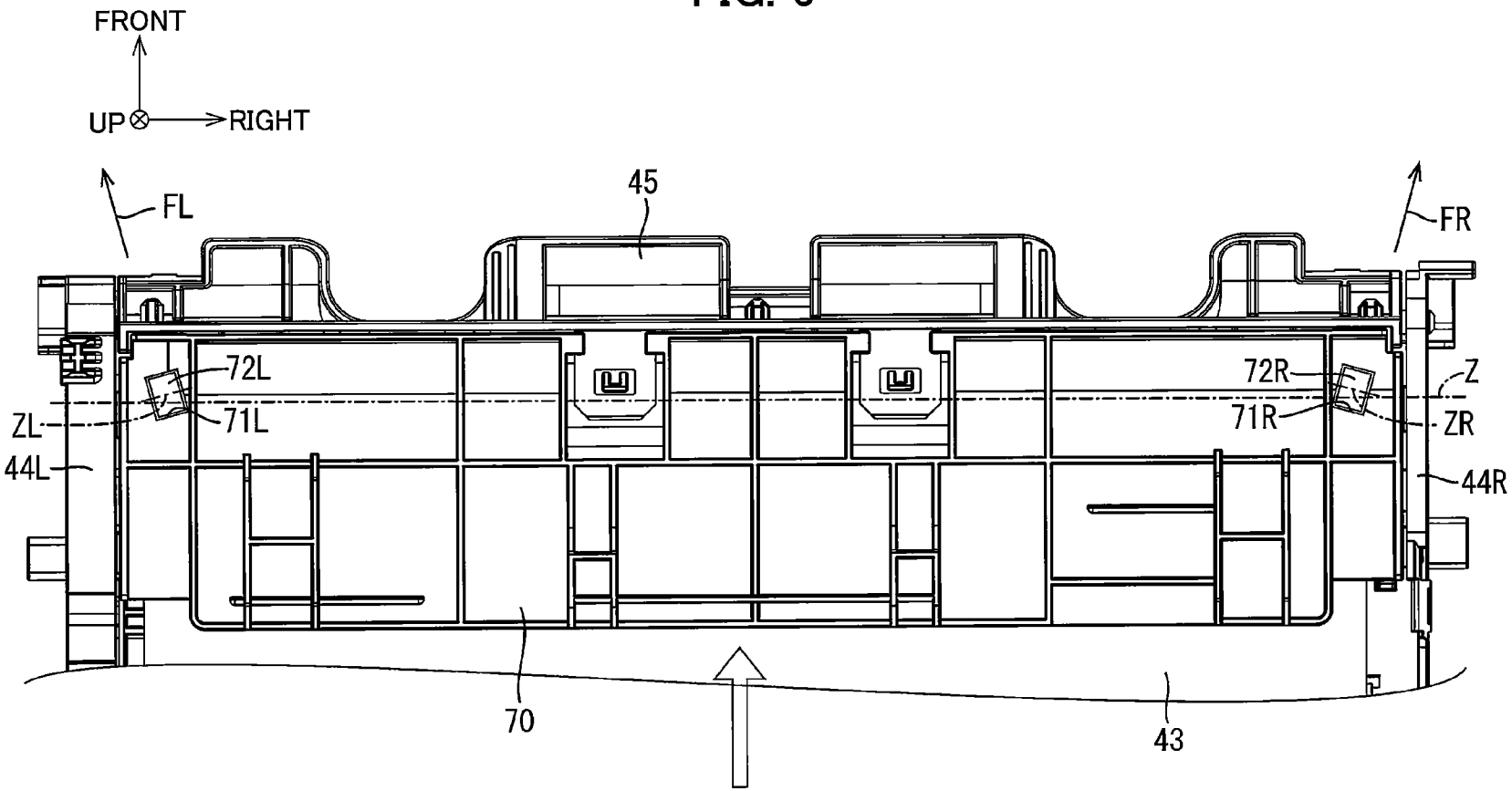
FIG. 5 is a lower view of a belt unit according to a second embodiment.

A belt conveying apparatus according to a second embodiment of the present invention is shown in FIG. 5. The second embodiment is the same as the first embodiment except a configuration of the regulation portion. Thus, like parts and components are designated by the same reference numerals as those shown in the first embodiment to avoid duplicating description.

As illustrated in FIG. 5, a bottom frame 70 has substantially the same shape as that of the bottom frame 46 illustrated in FIG. 3 except for the followings. That is, through-holes 71R and 71L are formed at both left and right end portions of the bottom frame 70. The through-holes 71R and 71L are arrayed with each other in the direction of the roller rotation axis Z, and located at substantially symmetrical positions with respect to a widthwise center (leftward/rightward center) position of the belt 43. Further, each of the through-holes 71R, 71L is directed obliquely with respect to the direction of the roller rotation axis Z.

Rotary bodies 72R and 72L are positioned in the through-holes 71R and 71L, respectively. Each of the rotary bodies 72R and 72L is contactable with the belt 43, and has substantially the same shape as that of the rotary body 61. Thus, the rotary bodies 72R and 72L are rotated with movement of the belt 43 in a state where they are positioned in the through-holes 71R and 71L, respectively.

The rotary body 72R and the rotary body 72L have rotation axis ZR and rotation axis ZL, respectively. These rotation axes ZR and ZL are inclined with respect to the moving direction of the belt 43 or with respect to the direction of the movement of the roller rotation axis Z, such that a distance between the axes ZR and ZL is gradually decreased in a movement direction of a lower surface of the belt 43, i.e., toward the front side of the belt unit 4.

More specifically, each rotary body 72R, 72L has an inner axial end face and an outer axial end face in the leftward/rightward direction. Here, with respect to the right rotary body ZR, the rotation axis ZR at the inner axial end face is positioned forward of the roller rotation axis Z in the movement direction of the lower surface of the belt 43. Thus, the rotary body 72R applies to the belt 43 a feeding force that feeds the belt 43 in a diagonally rightward direction FR when the rotary body 72R is rotated along with the movement of the belt 43.

On the other hand, with respect to the left rotary body ZL, the rotation axis ZL at the inner axial end face is positioned forward of the roller rotation axis Z in the movement direction of the lower surface of the belt 43. Thus, the rotary body 72L applies to the belt 43 a feeding force that feeds the belt 43 in a diagonally leftward direction FL when the rotary body 72L is rotated along with the movement of the belt 43. Thus, a force is applied to the belt 43 by the two rotary bodies 72R and 72L, such that the belt 43 is urged toward lateral directions opposite to each other, i.e., toward right edge of the belt 43 and the left edge of the belt 43. This force can restrain wrinkling of the belt 43 while preventing the guide rib 60 from coming off from the annular stepped guide portion 52A.

Third Embodiment

Figure 6:
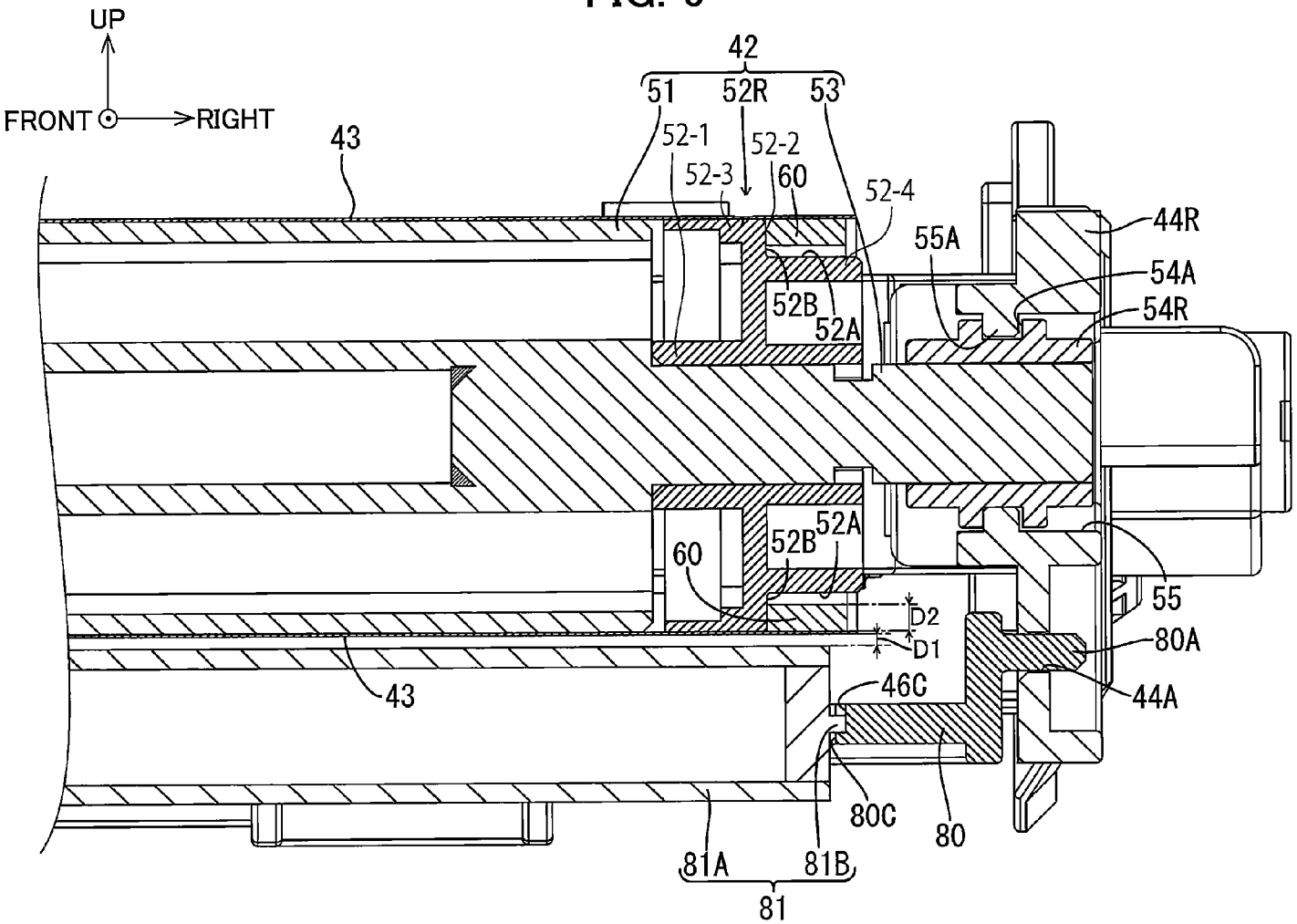
FIG. 6 is a cross-sectional view of a right portion of a belt unit according to a third embodiment.

A belt conveying apparatus according to a third embodiment of the present invention is shown in FIG. 6. The third embodiment is the same as the first embodiment except a configuration of the regulation portion. Thus, like parts and components are designated by the same reference numerals as those shown in the first embodiment to avoid duplicating description.

A bottom frame 80 includes fixing protrusions 80A similar to the fixing protrusions 46A, and has substantially the same shape as that of the bottom frame 46 illustrated in FIG. 3 except for the followings. That is, a through-hole 80C is formed in the bottom frame 80. The through-hole 80C has a leftward/rightward length substantially the same as the width of the belt 43. A single rotary body 81 is positioned in the through-hole 80C, and includes a cylindrical body 81A and shaft portions 81B and 81B each protruding from each lateral end of the cylindrical body 81A.

The body 81A has a width in leftward/rightward direction substantially the same as the width of the belt 43. Thus, an end portion of the body 81A is aligned with the guide rib 60 in leftward/rightward direction. In other words, the end portion of the body 81A faces a part of the outer surface of the belt 43, the part corresponding to the guide rib 60. This can prevent the guide rib 60 from coming off from the annular stepped guide portion 52A. Further, damage to the belt 43 can be eliminated because enlarged contact area of the body 81A relative to the belt 43 can be provided.

Fourth Embodiment

Figure 7:
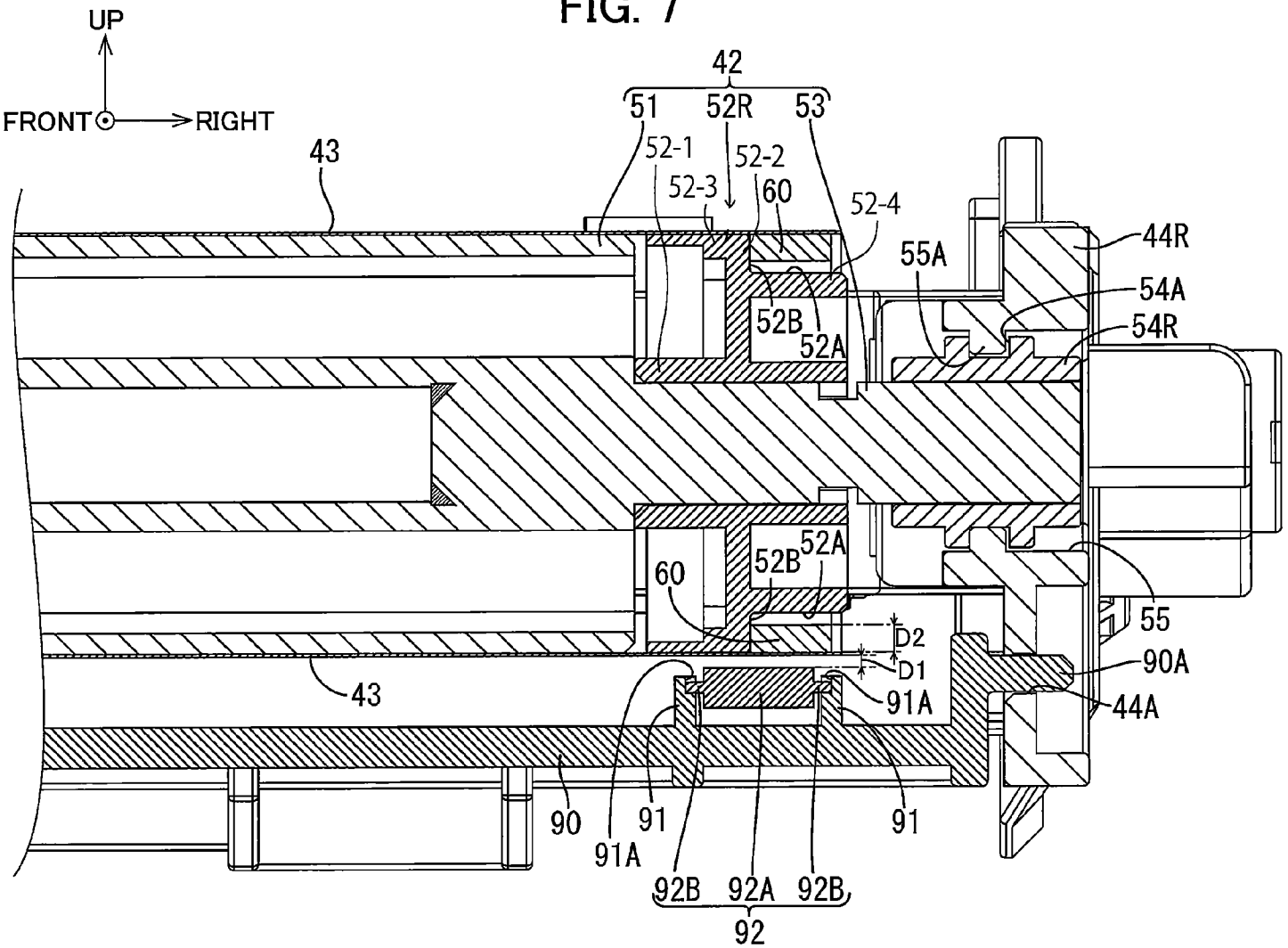
FIG. 7 is a cross-sectional view of a right portion of a belt unit according to a fourth embodiment.

A belt conveying apparatus according to a fourth embodiment of the present invention is shown in FIG. 7. The fourth embodiment is the same as the first embodiment except a configuration of the regulation portion. Thus, like parts and components are designated by the same reference numerals as those shown in the first embodiment to avoid duplicating description.

A bottom frame 90 has a fixing protrusion 90A similar to the fixing protrusions 46A of the first embodiment, and has substantially the same shape as that of the bottom frame 46 illustrated in FIG. 3 except for the followings. That is, a pair of support ribs 91 and 91 protrude upward from an upper surface of the bottom frame 90 at a position in alignment with the support roller 42. Bearings 91A are formed in the support ribs 91 and 91, respectively.

A rotary body 92 is rotatably supported by the pair of support ribs 91,91. The rotary body 92 includes a cylindrical body 92A and shaft portions 92B and 92B each protruding from each lateral end of the cylindrical body 92A. The body 92A has a width (axial length) substantially the same as the width of the guide rib 60. The shaft portions 92B and 92B are rotatably supported by the bearings 91A and 91A, respectively. With this configuration, the rotary body 92 is rotated when being brought into contact with the belt 43. A gap D1 between an upper surface of the rotary body 92 and outer surface of the belt 43 is smaller than the length D2 over which the guide rib 60 and the annular stepped guide portion 52A overlap each other in the radial direction of the support roller 42. This configuration prevents the guide rib 60 from coming off from the annular stepped guide portion 52A.

Fifth Embodiment

Figure 8:
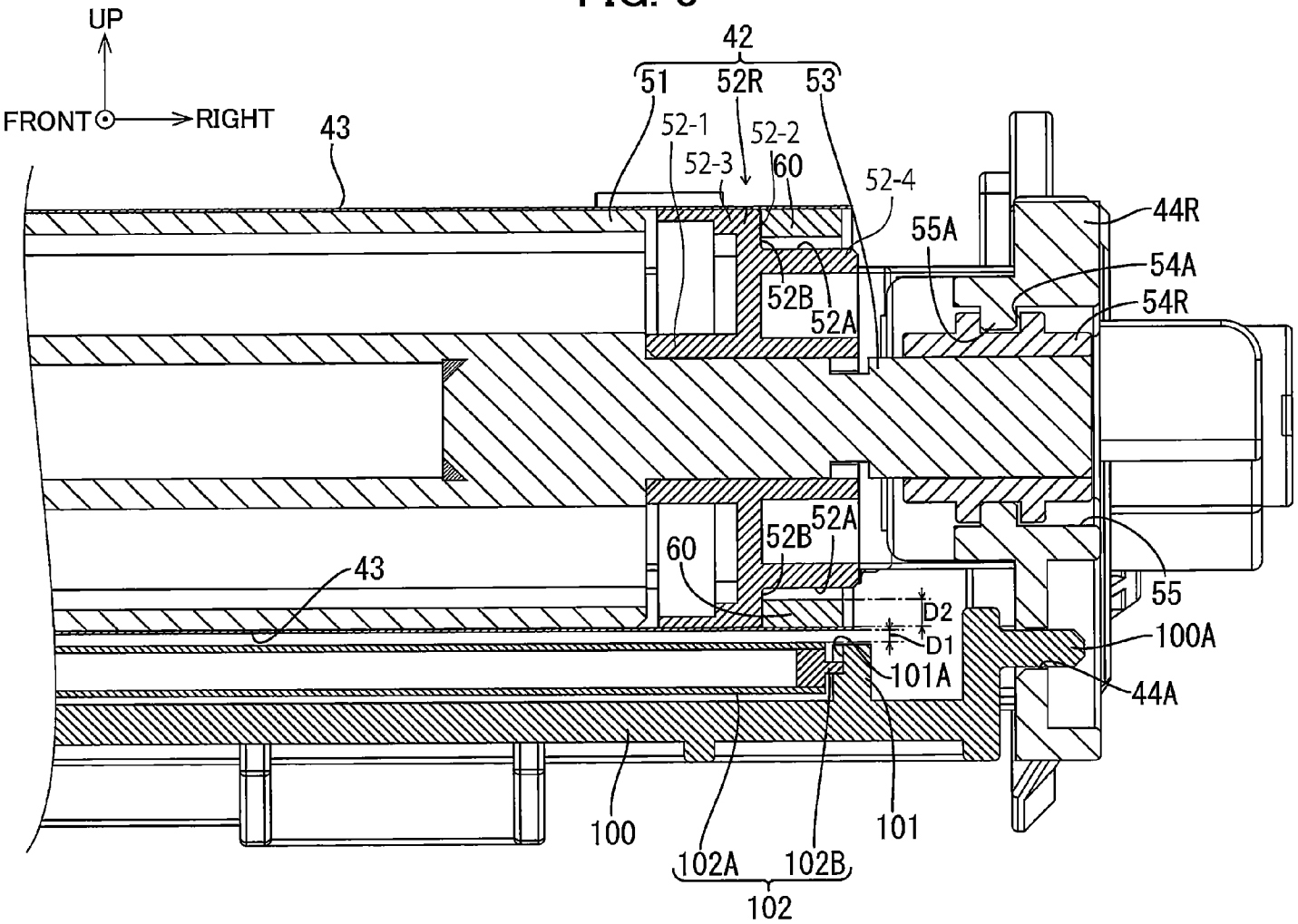
FIG. 8 is a cross-sectional view of a right portion of a belt unit according to a fifth embodiment.

A belt conveying apparatus according to a fifth embodiment of the present invention is shown in FIG. 8. The fifth embodiment is the same as the first embodiment except for the regulation portion. Thus, like parts and components are designated by the same reference numerals as those shown in the first embodiment to avoid duplicating description.

A bottom frame 100 includes a fixing protrusion 100A similar to the fixing protrusions 46A and has substantially the same shape as that of the bottom frame 46 illustrated in FIG. 3 except for the followings. That is, a pair of support ribs 101 and 101 (only a right support rib 101 is illustrated in FIG. 8) protrude upward from an upper surface of the bottom frame 100. Bearings 101A are formed in the support ribs 101 and 101, respectively.

A rotary body 102 is rotatably supported by the pair of support ribs 101,101. The rotary body 102 includes a cylindrical body 102A and shaft portions 102B and 102B each protruding from each end of the body 102A. The body 102A has leftward/rightward width substantially the same as the width of the belt 43. Specifically, an axial end portion of the body 102A is aligned with the guide rib 60 in leftward/rightward direction. In other words, the axial end portion of the body 102A faces a part of the outer surface of the belt 43, the part corresponding to the guide rib 60. This structure can prevent the guide rib 60 from coming off from the annular stepped guide portion 52A. Further, damage to the belt 43 can be eliminated because enlarged contact area of the body 102A relative to the belt 43 can be provided.

Sixth Embodiment

Figure 9:
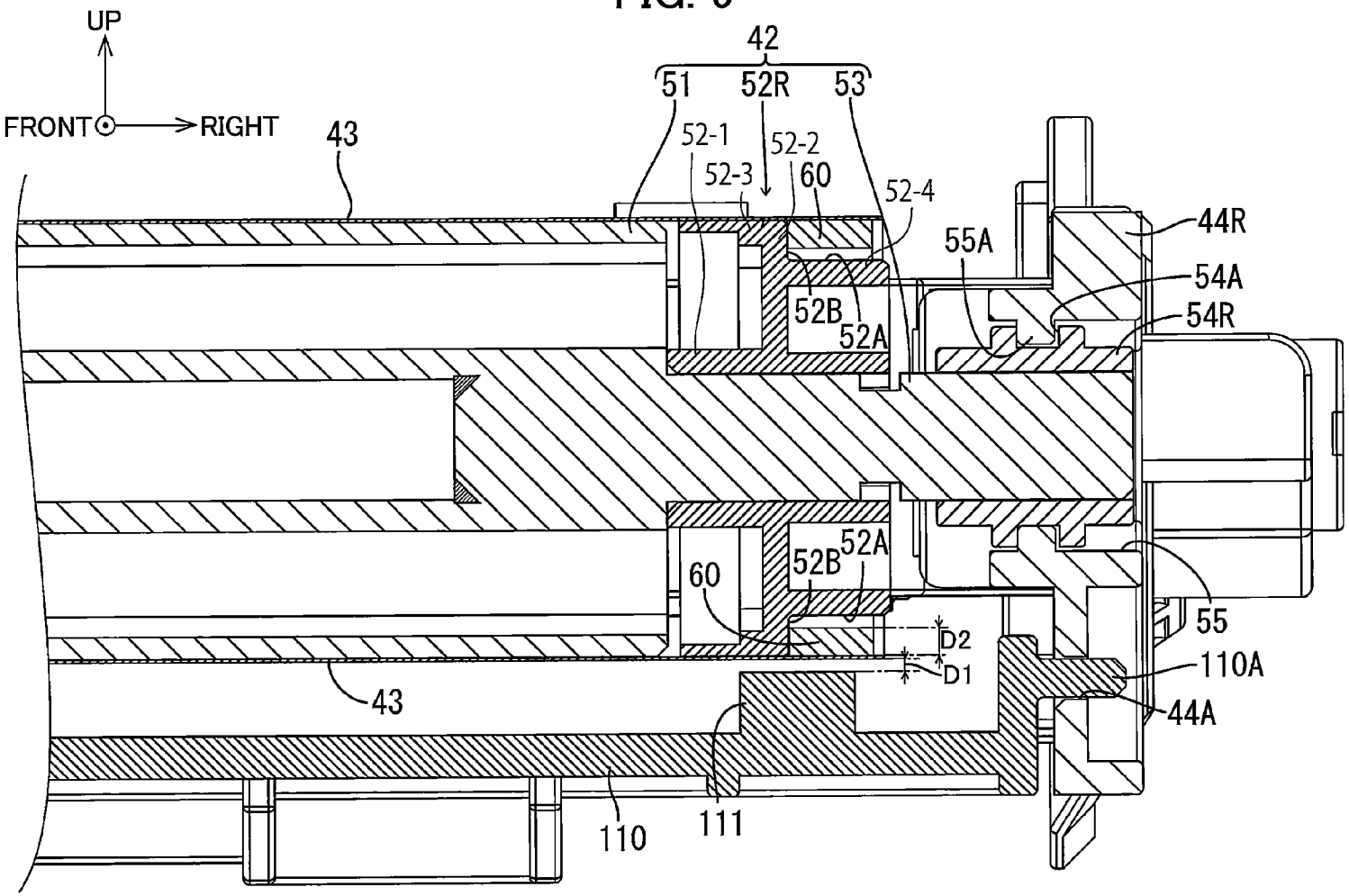
FIG. 9 is a cross-sectional view of a right portion of a belt unit according to a sixth embodiment.

A belt conveying apparatus according to a sixth embodiment of the present invention is shown in FIG. 9. The sixth embodiment is the same as the first embodiment except for the regulation portion. Thus, like parts and components are designated by the same reference numerals as those shown in the first embodiment to avoid duplicating description.

A bottom frame 110 includes a fixing protrusion 110A similar to the fixing protrusions 46A, and has substantially the same shape as that of the bottom frame 46 illustrated in FIG. 3 except for the following. That is, a guide convex portion 111 is integrally protrudes upward from an upper surface of the bottom frame 110. The guide convex portion 111 has leftward/rightward width substantially the same as that of the guide rib 60.

A gap D1 between an upper surface of the guide convex portion 111 and outer surface of the belt 43 is smaller than the length D2 over which the guide rib 60 and annular stepped guide portion 52A overlap each other in the radial direction of the support roller 42. This structure can prevent the guide rib 60 from coming off from the annular stepped guide portion 52A. The bottom frame 110 and guide convex portion 111 are an example of a regulating portion.

Seventh Embodiment

Figure 10:
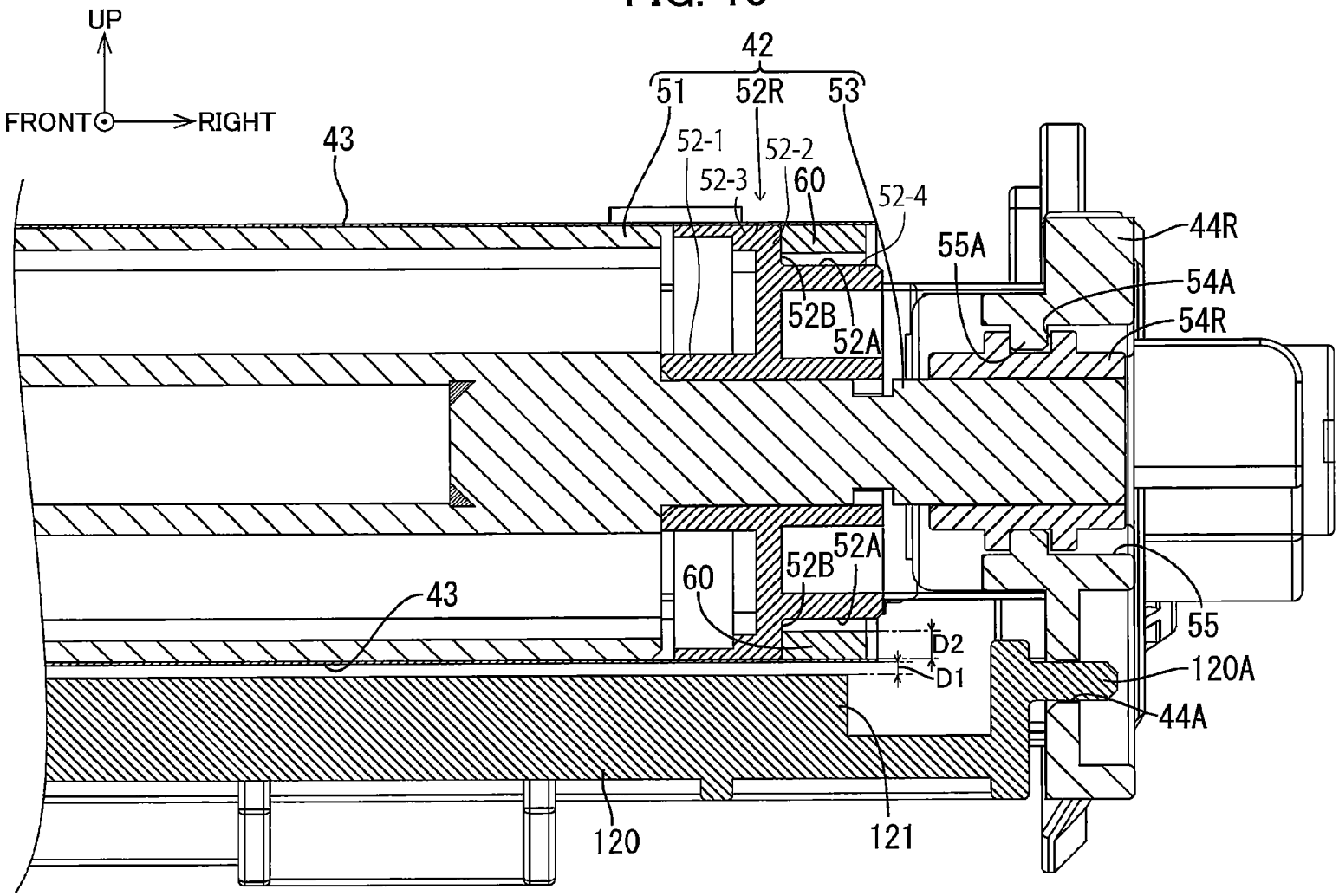
FIG. 10 is a cross-sectional view of a right portion of a belt unit according to a seventh embodiment.

A belt conveying apparatus according to a seventh embodiment of the present invention is shown in FIG. 10. The seventh embodiment is the same as the first embodiment except for the regulation portion. Thus, like parts and components are designated by the same reference numerals as those shown in the first embodiment to avoid duplicating description.

A bottom frame 120 includes a fixing protrusion 120A similar to the fixing protrusions 46A, and has substantially the same shape as that of the bottom frame 46 illustrated in FIG. 3 except for the following point. That is, a guide convex portion 121 is provided on an upper surface of the bottom frame 120 and integrally therewith. The guide convex portion 121 has a leftward/rightward width substantially the same as the width of the belt 43. More specifically, each end portion of the guide convex portion 121 is aligned with each guide rib 60 in leftward/rightward direction. In other words, the end portion of the guide convex portion 121 faces a part of the outer surface of the belt 43, the part corresponding to the guide rib 60. This structure can prevent the guide rib 60 from coming off from the annular stepped guide portion 52A.

The guide rib 60, the annular stepped guide portion 52A, and the rotary body 61 can be provided only at one of the left and right end portion of the support roller 42, or at both the left and right end portions thereof. Further, the guide rib 60 and the annular stepped guide portion 52A can be provided at the drive roller 41 and a bearing portion thereof. Further, a convex-shaped regulating portion can be provided at the outer peripheral surface side of the roller, and a concave-shaped regulating portion can be provided at the belt side.

Eighth Embodiment

The drive roller 41 is supported at rear side portions of the pair of the side frames 44R and 44L, respectively, so as to be rotatable about a rotation axis extending in the main scanning direction. Although not illustrated in FIG. 12, the belt 43 has a left end portion whose inner peripheral surface, i.e. peripheral surface on the support roller 42 side, has another convex-shaped guide rib 60. The convex-shaped guide rib 60 on the left end portion protrudes toward the inner side of the belt 43 as well as the convex-shaped guide rib 60 on the right end portion of the belt 43.

Figure 11:
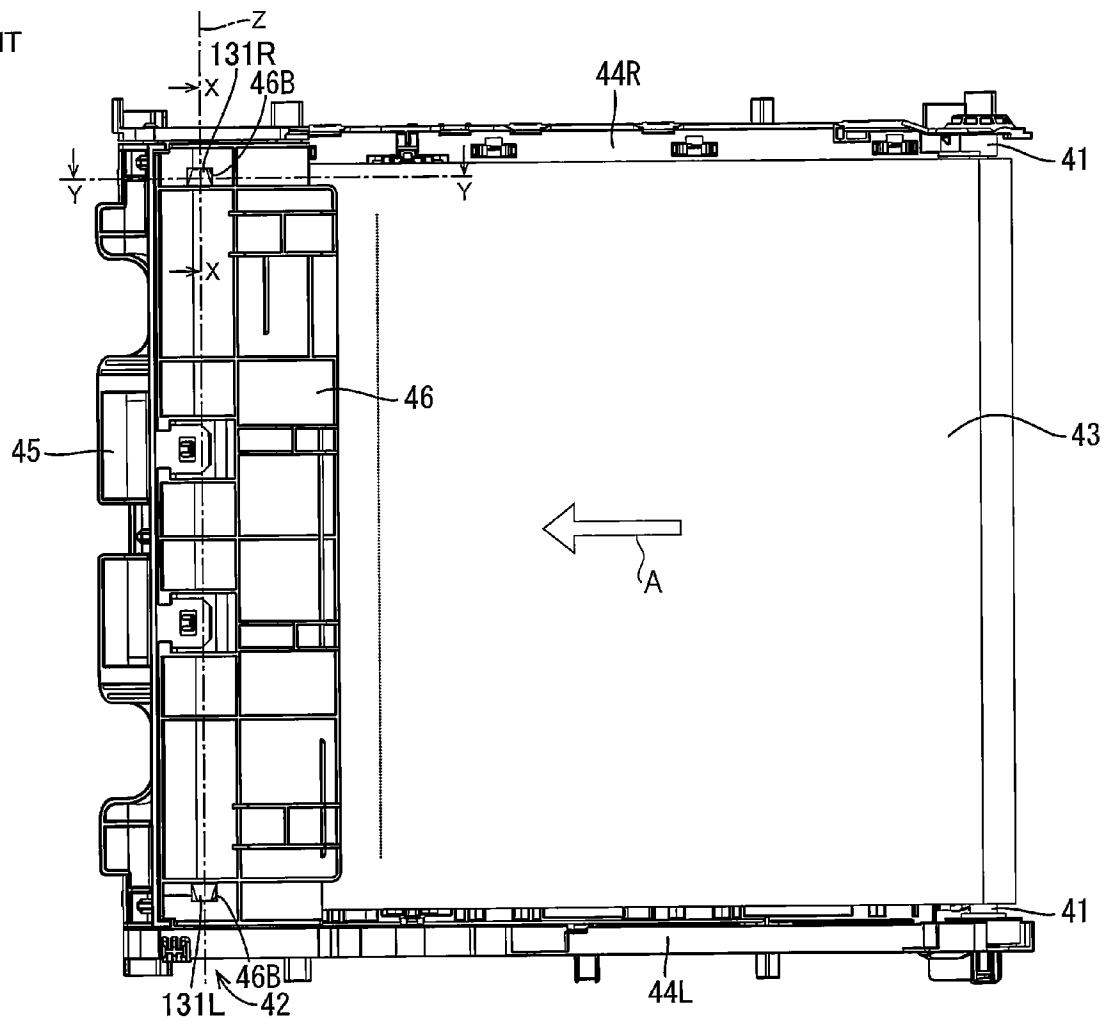
FIG. 11 is a lower view of a belt unit according to an eighth embodiment.

As illustrated in FIG. 11, two rotating bodies 131R and 131L are provided in the bottom frame 46 so as to be rotatable about a rotation axis extending parallel to the roller rotation axis Z. Specifically, in the bottom frame 46, two through-holes 46C are formed at respective positions below the flange sections 52R and 52L so as to penetrate the bottom frame 46. Each of the through-holes 46C only needs to be a recessed portion; the through-holes 46C may not necessarily be through-holes providing communication between the upper and lower sides of the bottom frame 46. That is, each of the through-holes 46C may be a recessed portion formed on an upper surface of the bottom frame 46. Bearings 46D and 46D are formed in left and right inner walls of each through-hole 46C, respectively (see FIG. 12).

Figure 12:
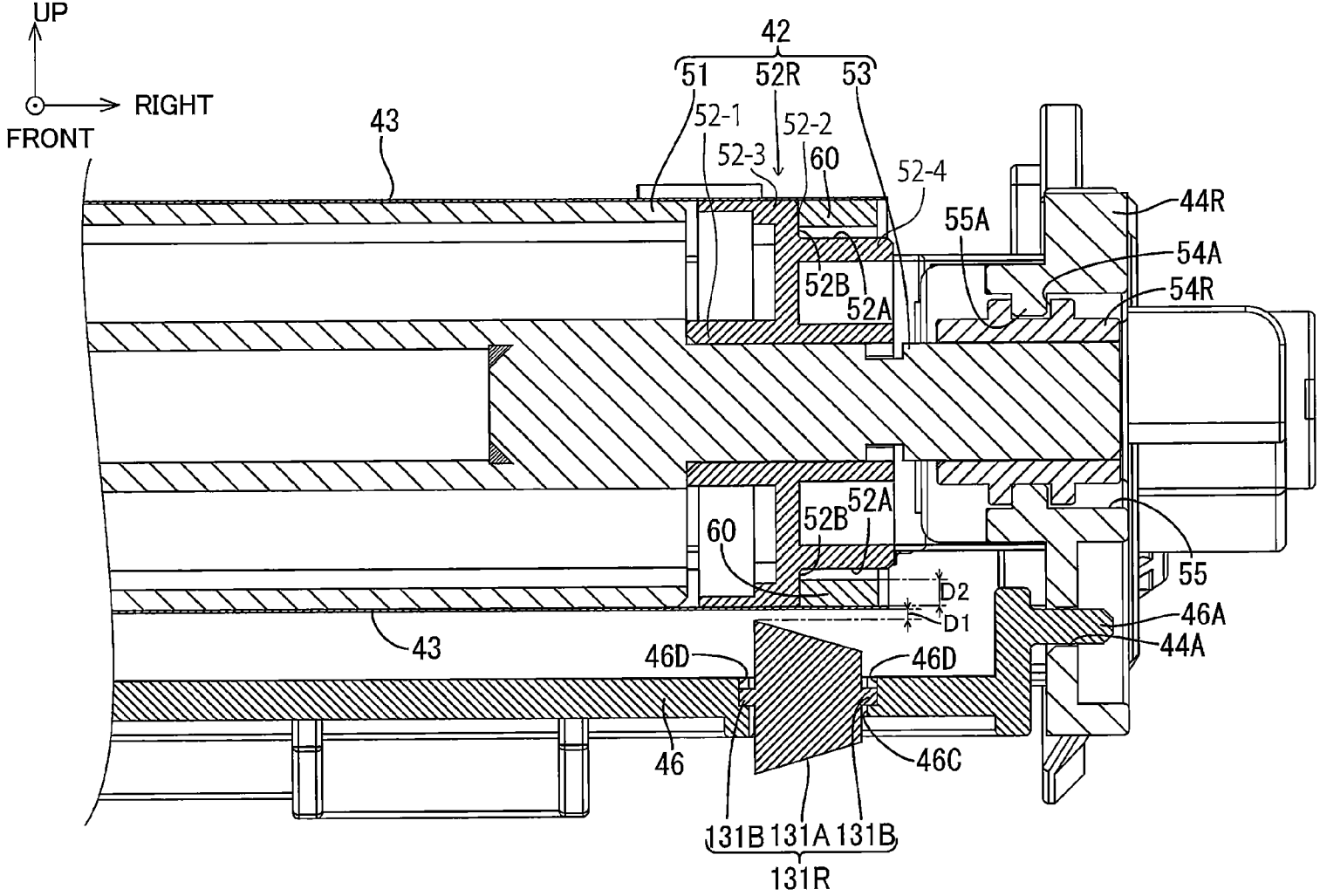
FIG. 12 is a cross-sectional view of the belt unit taken along line X-X of FIG. 11.
Figure 13:
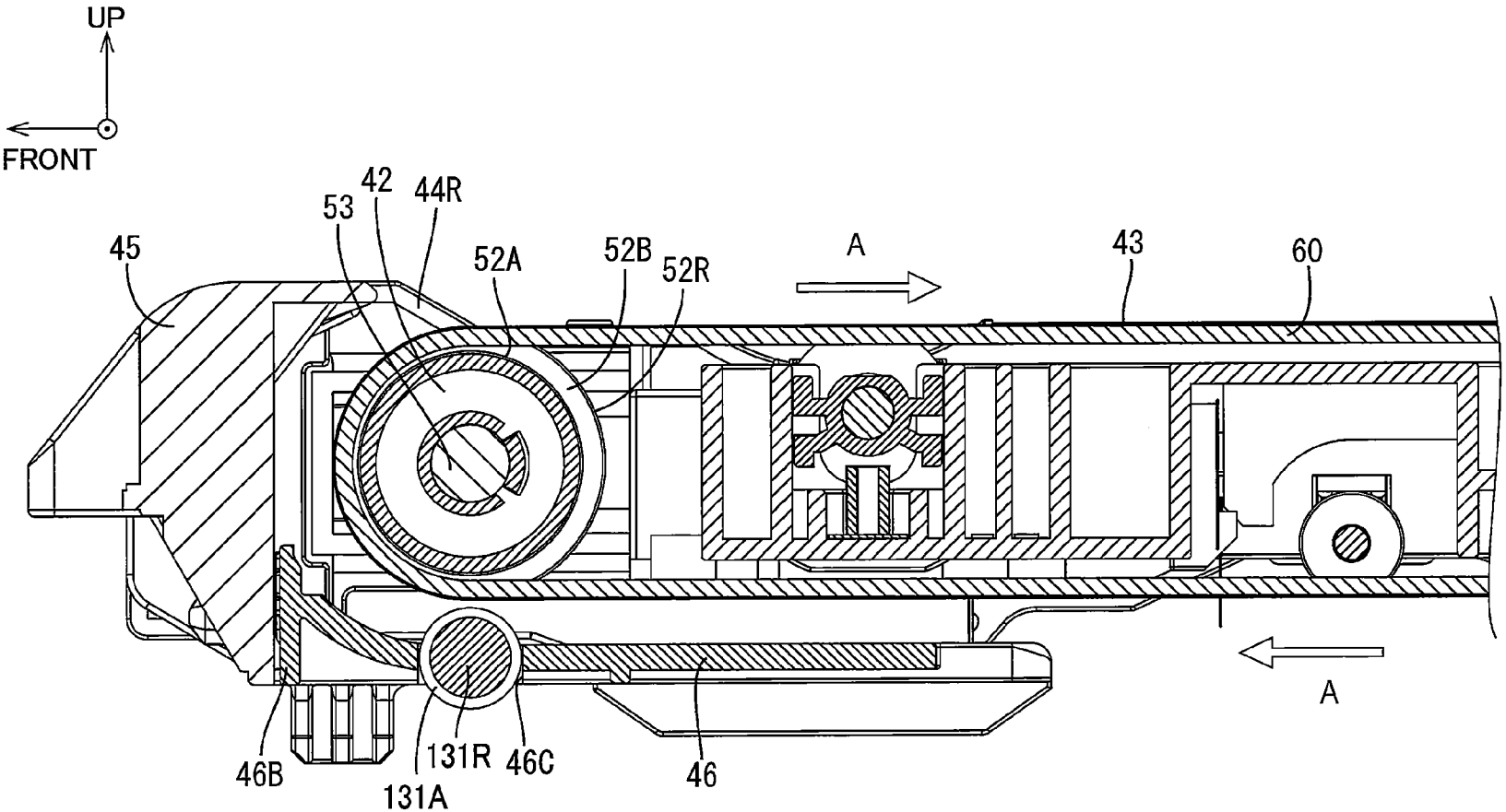
FIG. 13 is a cross-sectional view of the belt unit taken along line Y-Y of FIG. 11.

As illustrated in FIG. 12 and FIG. 13, the right-side rotating body 131R includes a body 131A and shaft portions 131B and 131B protruding to the leftward and rightward from the body 131A. The body 131A has such a shape that a gap from the periphery thereof to the outer surface of the belt 43 decreases toward a widthwise center of the belt 43. Specifically, the body 131A has a conical shape whose diameter increases in the left direction. The body 131A has a width in the leftward/rightward direction substantially the same as a width of the guide rib 60. The shaft portions 131B and 131B are supported at the bearings 46D and 46D of the through-hole 46C, respectively.

Although not illustrated in FIG. 12, the body 131A of the left-side rotating body 131L has such a shape that a gap from the periphery thereof to the outer surface of the belt 43 decreases toward the widthwise center of the belt 43. Specifically, the body 131A has a conical shape whose diameter increases in the right direction. The rotating bodies 131R and 131L are positioned respectively in the through-holes 46C of the bottom frame 46, and are rotated when being brought into contact with the belt 43. The rotating bodies 131R and 131L are each an example of a rotating member. The bottom frame 46 is an example of a support portion. The rotating bodies 131R and 131L and the bottom frame 46 are an example of a regulating portion.

As illustrated in FIG. 12, a shortest gap D1 between each of the rotating bodies 131R and 131L and outer surface of the belt 43 is smaller than a length D2, the thickness of the guide rib 60 as illustrated in FIG. 3. Note that the guide rib 60 has the constant length D2 along a portion that overlaps with the annular stepped guide portion 52A in the radial direction of the support roller 42, i.e. the vertical direction as indicated in FIG. 3. Specifically, the shortest gap D1 is a gap between an upper surface of a largest diameter portion of each of the rotating bodies 131R and 131L and the outer surface of the belt 43. Thus, even when the guide rib 60 starts separating from the annular stepped guide portion 52A, the outer surface of the belt 43 abuts the rotating bodies 131R and 131L. Accordingly, the separation or the disengagement of the guide rib 60 from the annular stepped guide portion 52A can be prevented.

Figure 14:
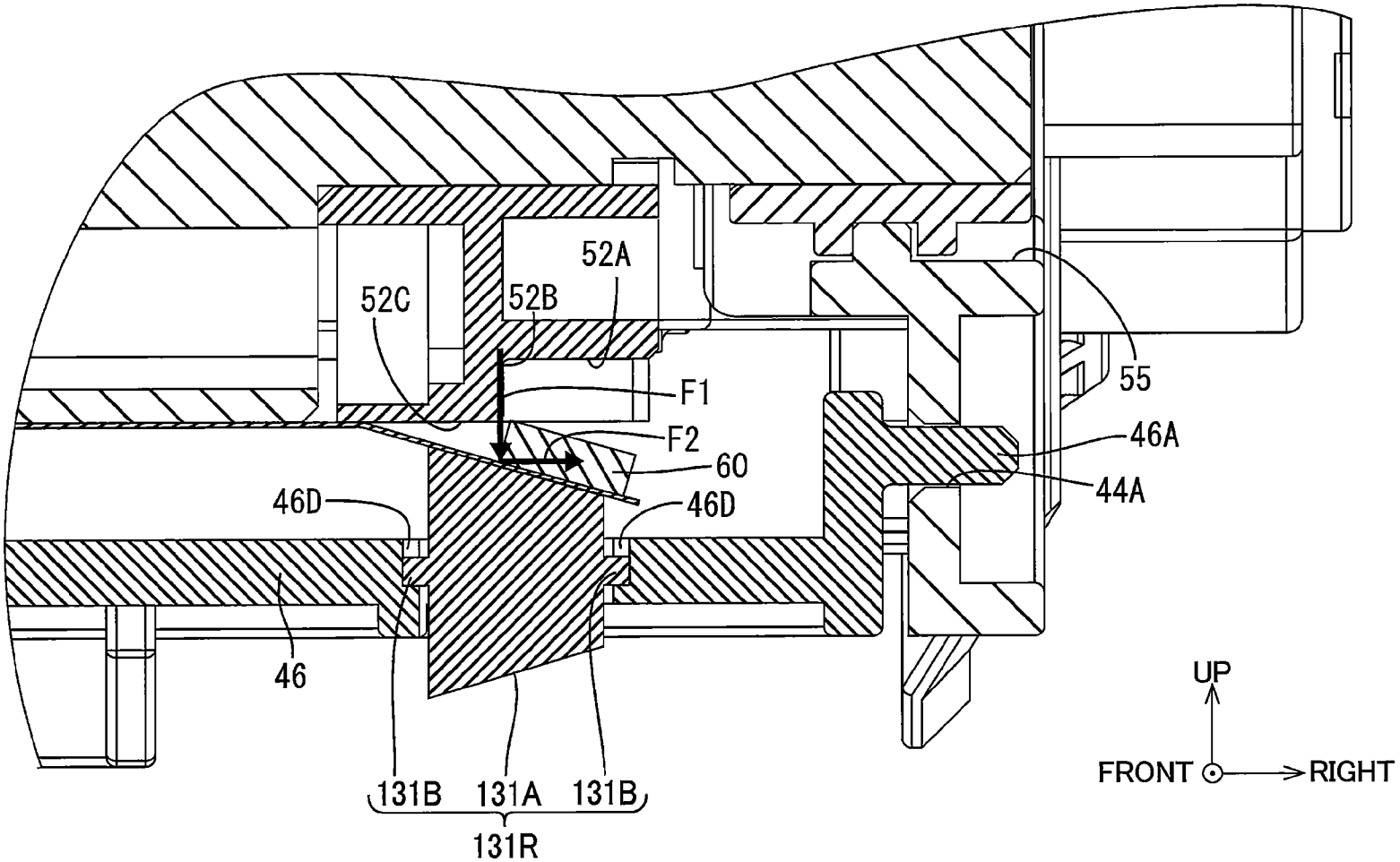
FIG. 14 is an enlarged view of a cross-section of the belt unit.

Further, as illustrated in FIG. 14, when the guide rib 60 starts to come off from the annular stepped guide portion 52A, the guide rib 60 may be sandwiched between the rotating body 131R and the annular stepped guide portion 52A or a portion adjacent to the annular stepped guide portion 52A. In this case, the rotating body 131R receives a pressing force F1 caused by the abutting against the belt 43.

As described above, the body 131A of the rotating body 131R has such a shape that the gap therefrom to the outer surface of the belt 43 decreases toward the widthwise center of the belt 43. Thus, the belt 43 receives, from the rotating body 131R, a restoring force F2 that pushes back the guide rib 60 to the right end side of the support roller 42 as a horizontal component force of a reaction force of the pressing force F1. The pressing force F1 becomes larger as the belt 43 is pulled toward the widthwise center of the support roller 42, and the restoring force F2 correspondingly increases. As a result, the guide rib 60 is pushed back to the annular stepped guide portion 52A. As described above, a state where the belt 43 is kept to deviate from the support roller 42 can be prevented.

Further, the two rotating bodies 131R and 131L are disposed at substantially symmetrical positions with respect to the center position of the support roller 42 (see FIG. 11). Thus, each side of the restoring force F2 that pulls the belt 43 in the leftward/rightward direction is applied to the belt 43 when they are rotated together with movement of the belt 43. This can suppress wrinkling of the belt 43.

Further, the outer peripheral surface of each of the rotating bodies 131R and 131L is linearly inclined with respect to the roller rotation axis Z. As compared to a configuration in which the outer peripheral surface forms a stepped shape brought close to the belt outer surface in a stepwise manner, damage of the belt 43 due to abutment of the rotating bodies 131R and 131L can be prevented more reliably. The outer peripheral surface is an example of a surface of the roller.

In addition, the rotating bodies 131R and 131L are provided in the bottom frame 46, which is integrally disposed in the side frame 44 that bears a shaft of the support roller 42. Thus, as compared to a case where the rotating bodies 131R and 131L are provided in a separated component from the belt unit 4, such as the image forming section 5, a positional relationship and a gap between the outer surface of the belt 43 and each of the rotating bodies 131R and 131L can be maintained even when the belt unit 4 or image forming section 5 is moved for replacement. As a result, disengagement of the guide rib 60 from the annular stepped guide portion 52A can be prevented.

Further, the rotating bodies 131R and 131L are each disposed so as to overlap both the guide rib 60 and a portion 52C of the flange section 52R (or flange 52L) that is adjacent to the annular stepped guide portion 52A in the direction of the roller rotation axis Z. In other words, the rotating bodies 131R and 131L each opposes the guide rib 60 and the adjacent portion 52C with respect to the belt 43. As compared to a configuration in which each of the rotating bodies 131R and 131L vertically overlaps with only one of the guide ribs 60 and the adjacent portion in the direction of the roller rotation axis Z, disengagement of the guide rib 60 from annular stepped guide portion 52A can be prevented more reliably.

Further, the regulating portion includes the rotating bodies 131R and 131L. Thus, as compared to a configuration in which the regulating portion is constituted by a fixed member that is not rotatable, damage of the belt 43 due to the contact with the regulating portion can be prevented more significantly. Further, as described above, the rotating bodies 131R and 131L are rotated when being brought into contact with the belt 43 in a state where they are positioned in the respective through-holes 46C of the bottom frame 46. Thus, in comparison with the configuration (see FIG. 15) in which the rotating body is not installed in the concave portion and the gap between the bottom frame 46 and outer surface of the belt 43 is the same, the rotating body 131 can have the larger diameter. This correspondingly increases a contact area between each of the rotating bodies 131R and 131L and belt 43 to lower the pressing force of the rotating body 131 against the belt 43, thereby preventing damage of the belt 43.

Further, the rotating bodies 131R and 131L are each provided on the outer surface of a part of the belt 43 that moves from the cleaner 6 toward the image forming section 5. This structure can prevent the rotating bodies 131R and 131L from being contaminated by coloring materials adhered to the belt 43. Further, this can prevent a re-adhesion of the coloring materials on the rotating bodies 131R and 131L to the belt 43. Further, adhesion of the coloring materials onto the rotating bodies 131R and 131L from the belt 43 can be prevented, and thus the force pushing back the guide rib 60 toward the annular stepped guide portion 52A is maintained.

The rotating bodies 131R and 131L are disposed on the vicinity of the outer surface of a non-stretched portion 43B of the belt 43. Here, a stretched portion 43A is a part of the belt 43 that is moved from the support roller 42 toward the drive roller 41 and is used for conveyance of the sheet W; the non-stretched portion 43B is a part of the belt 43 that is moved from the drive roller 41 toward the support roller 42 and is not used for conveyance of the sheet W. As compared to a configuration in which the rotating bodies 131R and 131L are positioned on the outer surface side of the stretched portion 34A, the sheet W and rotating bodies 131R and 131L can be prevented from interfering with each other more reliably.

Ninth Embodiment

Figure 15:
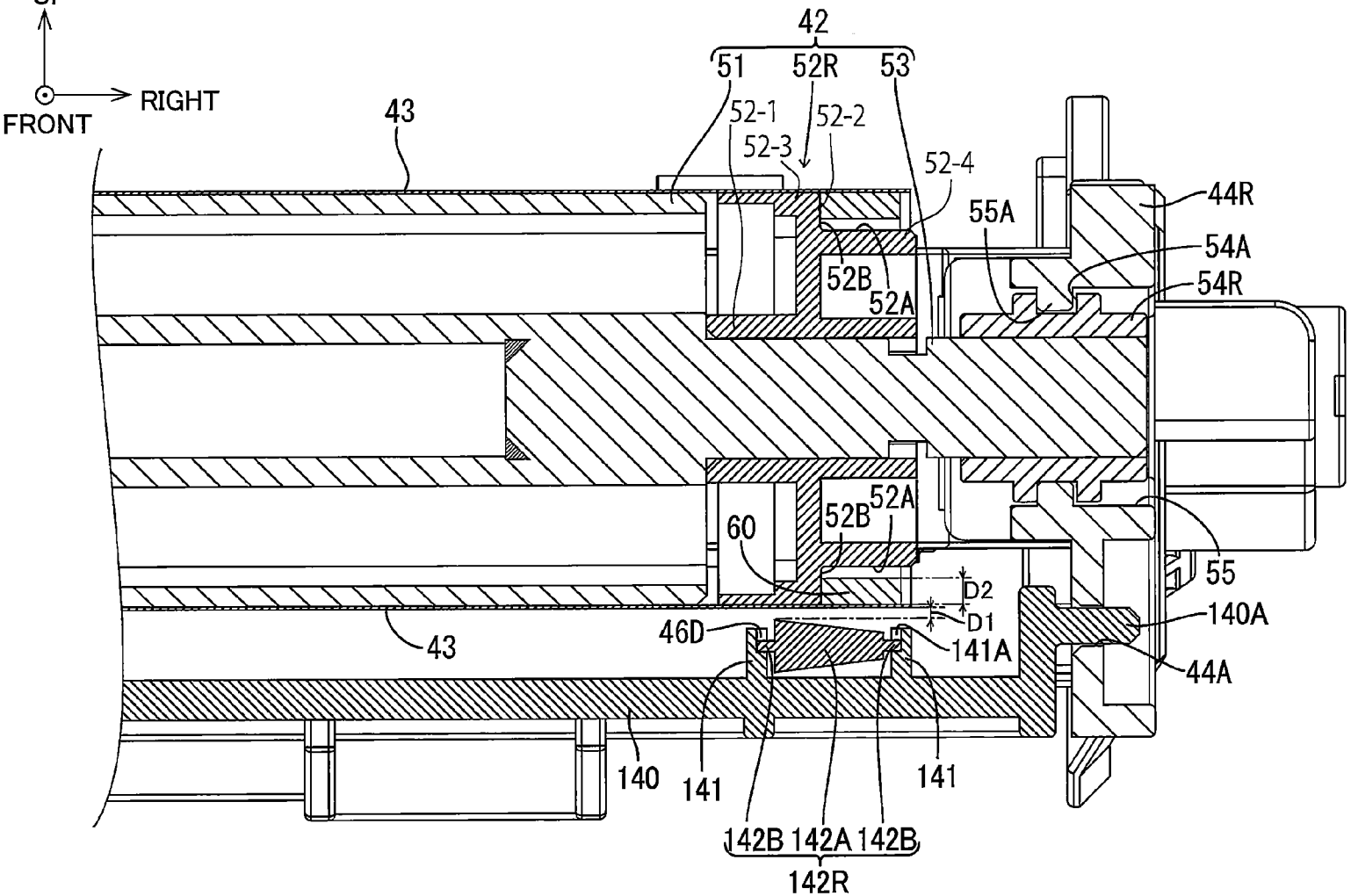
FIG. 15 is a cross-sectional view of a right portion of a belt unit according to a ninth embodiment.

FIG. 15 illustrates a ninth embodiment. This embodiment differs from the above embodiment in the configuration of the regulation portion, and other configurations are the same as those in the above embodiment. Thus, the same parts in the subsequent drawings are denoted by the same reference numerals, so detailed descriptions thereof are omitted and only different parts will be described.

A configuration illustrated in FIG. 15 differs from that of FIG. 12 in the structure of the regulating portion. Specifically, an underframe 140 includes a fixing convex portion 140A similar to the fixing protrusions 46A and has substantially the same shape as that of the bottom frame 46 illustrated in FIG. 12 except for the followings. That is, a pair of base portions 141 and 141 protrude upward on an upper surface of the underframe 140. Bearings 141A are formed in the base portions 141 and 141, respectively.

A rotating body 142R includes a body 142A and shaft portions 142B and 142B protruding in the leftward/rightward direction from the body 142A. The body 142A has a gap from the periphery thereof to the outer surface of the belt 43 that decreases toward the widthwise center of the belt 43. Specifically, the body 142A has a conical shape whose diameter increases in the leftward direction. The body 142A has a width in the leftward/rightward direction, which is substantially the same as that of the guide rib 60. The shaft portions 142B and 142B are supported at the bearings 141A and 141A of the through-hole 46C, respectively. With this configuration, the rotating body 142R is rotated when being brought into contact with the belt 43.

A shortest gap D1 between the upper surface of the rotating body 142R and the outer surface of the belt 43 is smaller than the length D2 over which the guide rib 60 and the annular stepped guide portion 52A overlap with each other in the radial direction of the support roller 42. Thus, even when the guide rib 60 starts separating from the annular stepped guide portion 52A, the guide rib 60 is pushed back to the annular stepped guide portion 52A by the rotating body 142R, resulting in the prevention of a state where the belt 43 is kept to deviate from the support roller 42.

Tenth Embodiment

Figure 16:
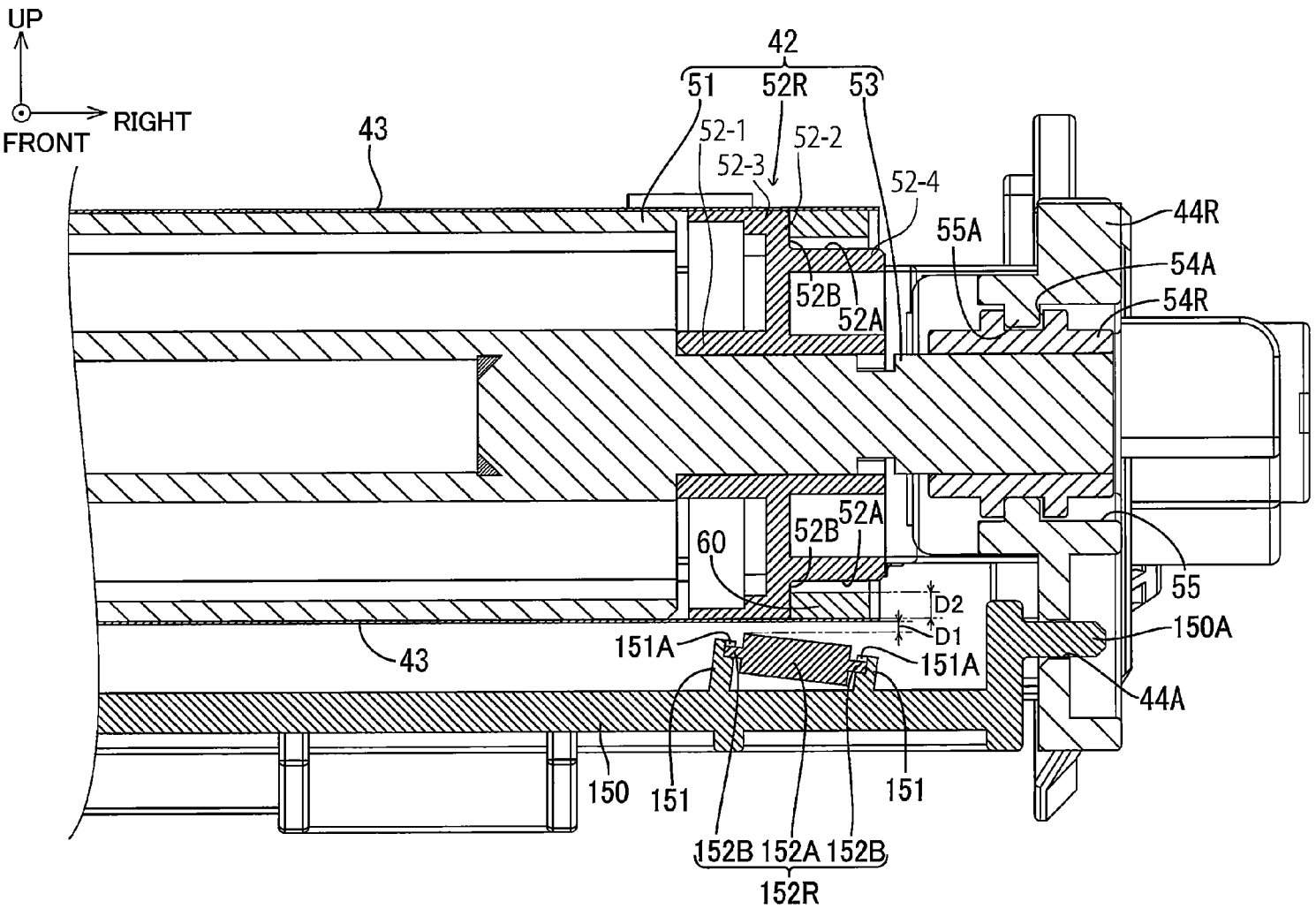
FIG. 16 is a cross-sectional view of a right portion of a belt unit according to a tenth embodiment.

FIG. 16 illustrates a tenth embodiment. This embodiment differs from the above embodiments in the configuration of the regulation portion, and other configurations are the same as those in the above embodiments. Thus, the same parts in the subsequent drawings are denoted by the same reference numerals, so detailed descriptions thereof are omitted and only different parts will be described.

An underframe 150 includes a fixing convex portion 150A similar to the fixing protrusions 46A and has substantially the same shape as that of the bottom frame 46 illustrated in FIG. 12 except for the followings. That is, a pair of base portions 151 and 151 protrude upward on an upper surface of the underframe 150. Bearings 151A are formed in the base portions 151 and 151, respectively.

A rotating body 152R includes a cylindrical body 152A and shaft portions 152B and 152B protruding in the leftward/rightward direction from the body 152A. The body 152A has a width in the leftward/rightward direction, which is substantially the same as that of the guide rib 60. The rotating body 152R is rotatably supported about a rotation axis inclined so that the body 152A approaches the outer surface of the belt 43 toward the widthwise center of the belt 43. That is, the rotating body 152R has a gap from the periphery thereof to the outer surface of the belt 43 that decreases toward the center of the belt 43.

A shortest gap D1 between an upper surface of the rotating body 152R and outer surface of the belt 43 is smaller than the length D2 over which the guide rib 60 and the annular stepped guide portion 52A overlap each other in the radial direction of the support roller 42. Thus, even when the guide rib 60 starts separating from the annular stepped guide portion 52A, the guide rib 60 is pushed back to the annular stepped guide portion 52A by the rotating body 152R, thereby preventing a state where the belt 43 is kept to deviate from the support roller 42.

Eleventh Embodiment

Figure 17:
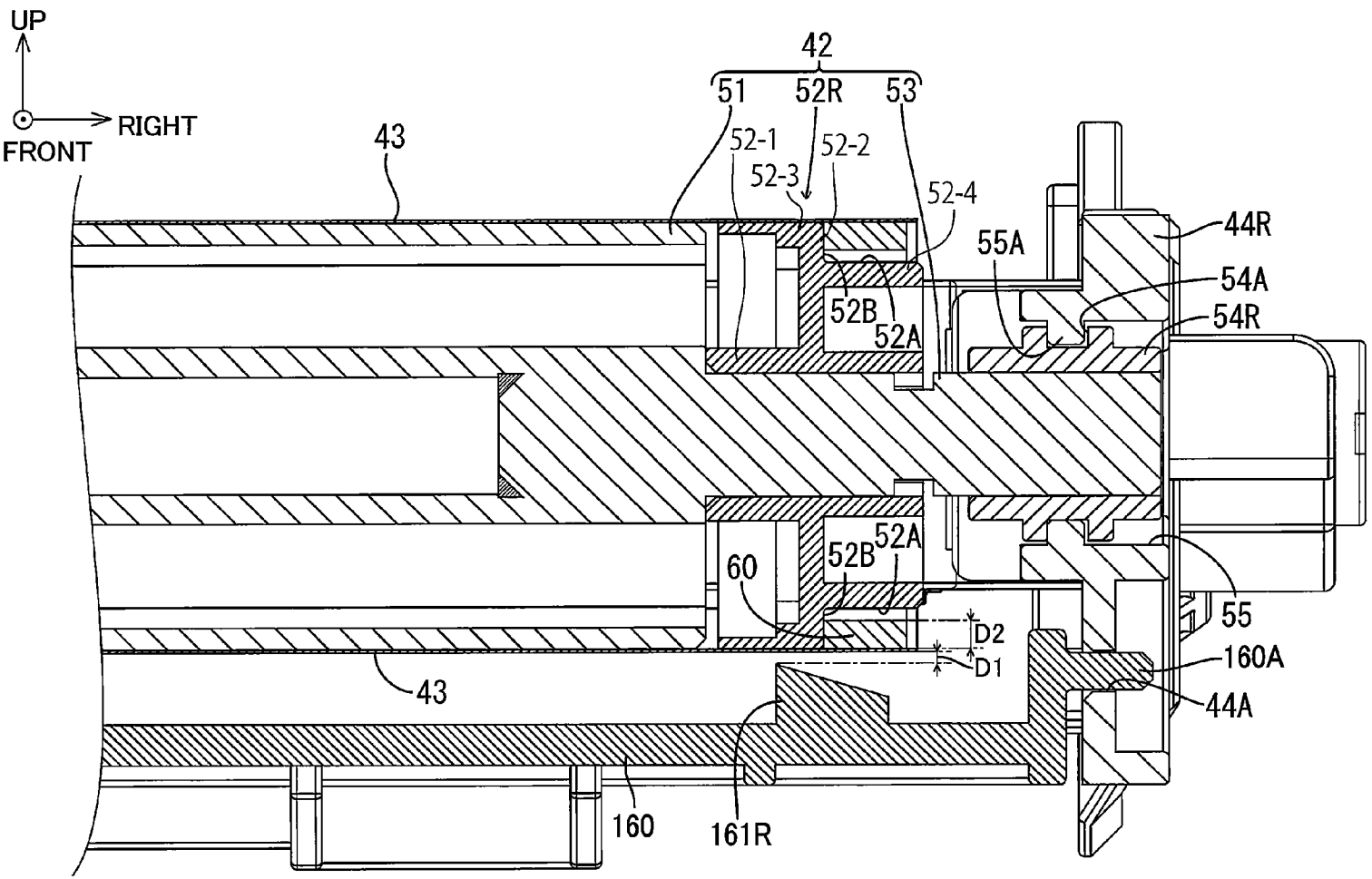
FIG. 17 is a cross-sectional view of a right portion of a belt unit according to an eleventh embodiment.

FIG. 17 illustrates an eleventh embodiment. This embodiment differs from the above embodiments in the configuration of the regulation portion, and other configurations are the same as those in the above embodiments. Thus, the same parts in the subsequent drawings are denoted by the same reference numerals, so detailed descriptions thereof are omitted and only different parts will be described.

An underframe 160 includes a fixing convex portion 160A similar to the fixing protrusions 46A and has substantially the same shape as that of the bottom frame 46 illustrated in FIG. 12 except for the followings. That is, a guide convex portion 161R integrally protrudes upward on an upper surface of the underframe 160. The guide convex portion 161R has a width in the leftward/rightward direction, which is substantially the same as that of the guide rib 60.

An upper surface of the guide convex portion 161R is inclined such that a gap from the periphery thereof to the outer surface of the belt 43 decreases toward the widthwise center of the belt 43. Further, a shortest gap D1 between an upper surface of the guide convex portion 161R and outer surface of the belt 43 is smaller than the length D2 over which the guide rib 60 and the annular stepped guide portion 52A overlap with each other in the radial direction of the support roller 42. Thus, even when the guide rib 60 starts separating from the annular stepped guide portion 52A, the guide rib 60 is pushed back to the annular stepped guide portion 52A by the guide convex portion 161R, thereby preventing a state where the belt 43 is kept to deviate from the support roller 42.

Twelfth Embodiment

Figure 18:
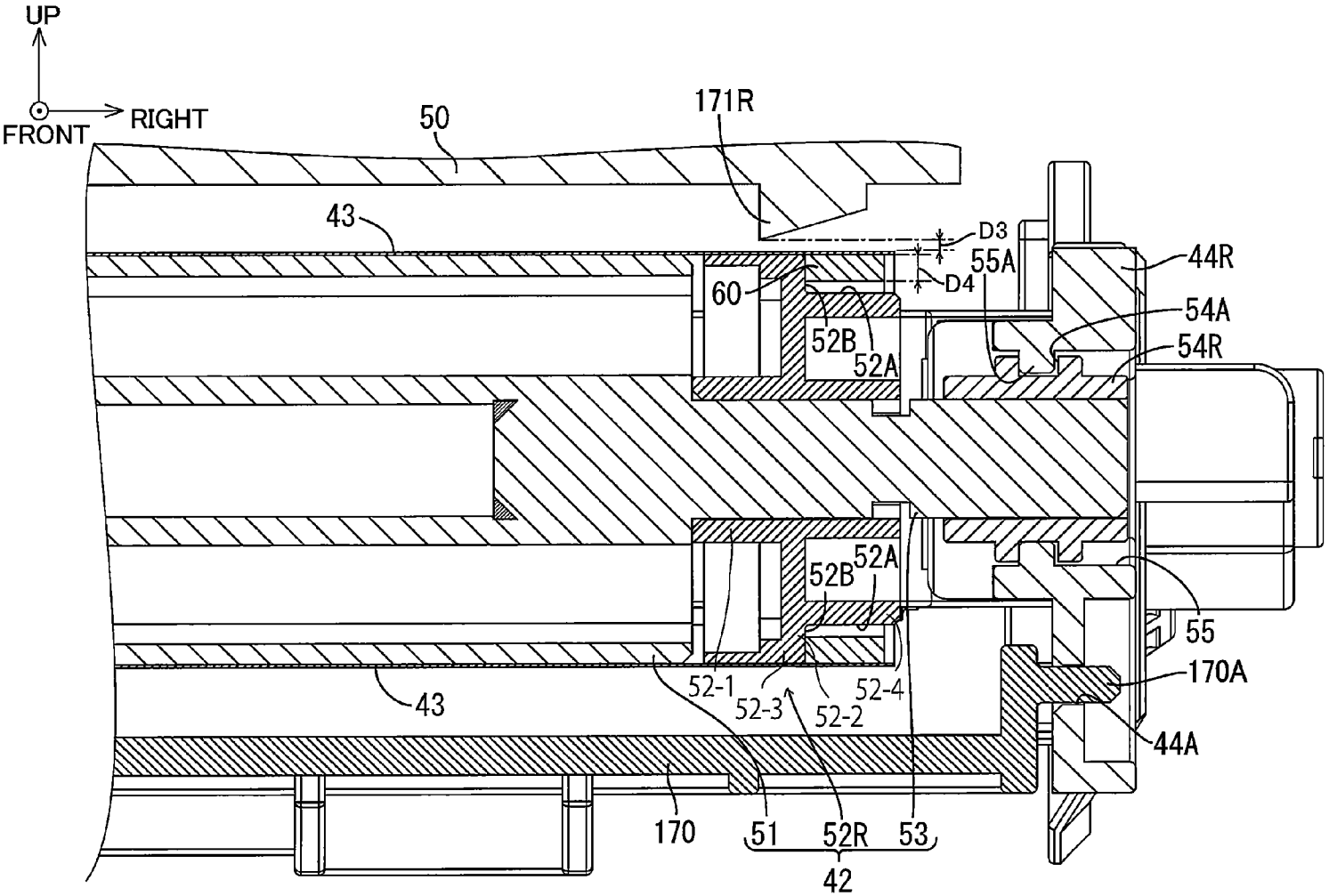
FIG. 18 is a cross-sectional view of a right portion of a belt unit according to a twelfth embodiment.

FIG. 18 illustrates a twelfth embodiment. This embodiment differs from the above embodiments in the configuration of the regulation portion, and other configurations are the same as those in the above embodiments. Thus, the same parts in the subsequent drawings are denoted by the same reference numerals, so detailed descriptions thereof are omitted and only different parts will be described.

An underframe 170 includes a fixing convex portion 170A similar to the fixing protrusions 46A and has substantially the same shape as that of the bottom frame 46 illustrated in FIG. 12 except for the followings. That is, the regulating portion is not provided on an upper surface of the underframe 170.

On the other hand, a guide convex portion 171R integrally protrudes on a lower surface of a drawer 50. The guide convex portion 171R has a width in the leftward/rightward direction, which is substantially the same as that of the guide rib 60. The lower surface of the guide convex portion 171R is inclined such that a gap therefrom to the outer surface of the belt 43 decreases toward the widthwise center of the belt 43. Further, a shortest gap D3 between the lower surface of the guide convex portion 171R and outer surface of the belt 43 is smaller than a length D4 over which the guide rib 60 and the annular stepped guide portion 52A overlap with each other in the radial direction of the support roller 42.

With the above configuration, even when the guide rib 60 starts separating from the annular stepped guide portion 52A, the guide rib 60 is pushed back to the annular stepped guide portion 52A by the guide convex portion 171R, thereby preventing a state where the belt 43 is kept to deviate from the support roller 42. The guide convex portion 171R is disposed widthwise outside from an area in which the sheet W to be conveyed to the belt 43 passes.

Thirteenth Embodiment

Figure 19:
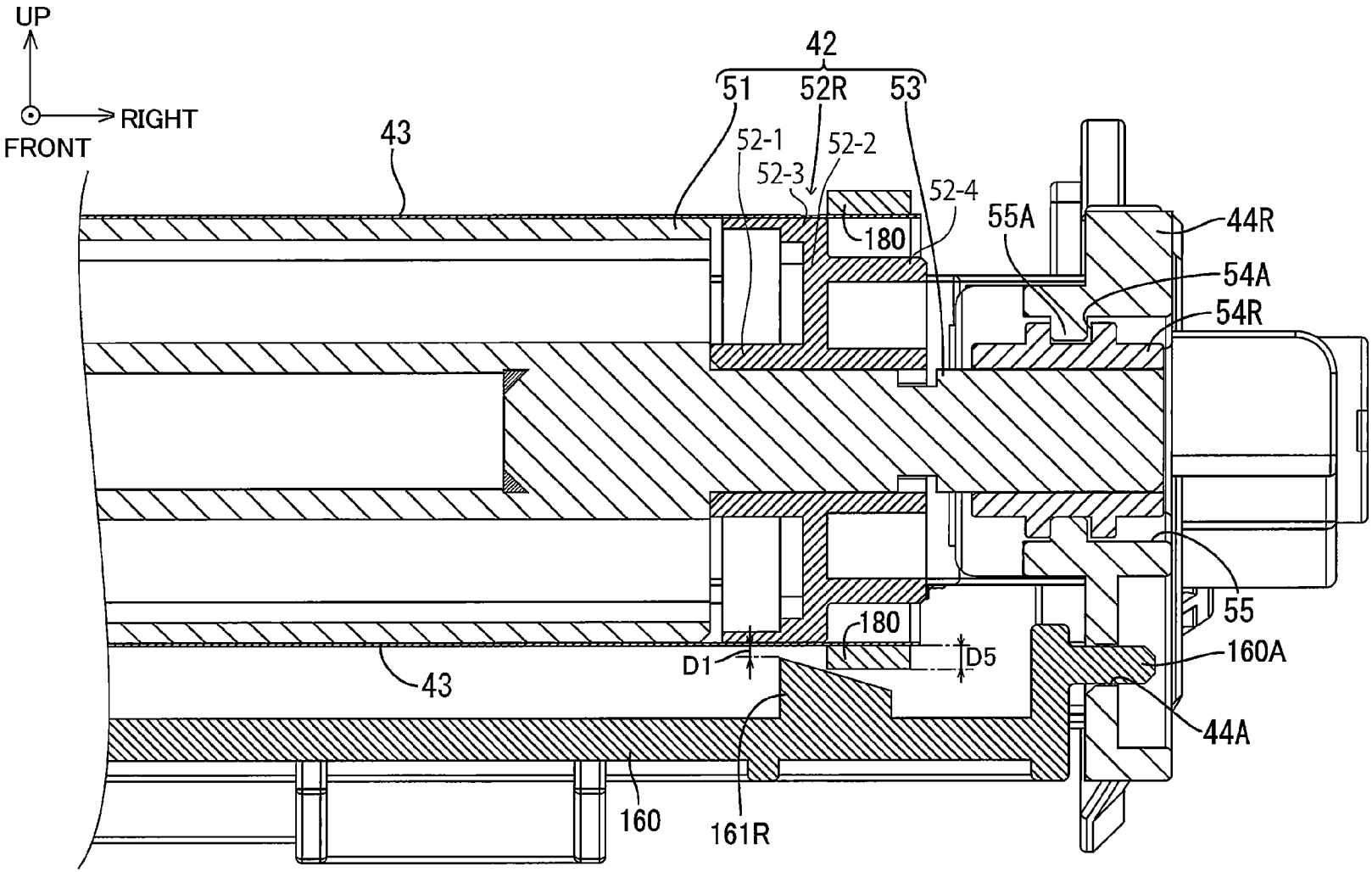
FIG. 19 is a cross-sectional view of a right portion of a belt unit according to a thirteenth embodiment.

FIG. 19 illustrates a thirteenth embodiment. This embodiment differs from the embodiment illustrated in FIG. 17 in the configuration of the guide rib, and other configurations are the same as those in the embodiment of FIG. 17. Thus, the same parts in the subsequent drawings are denoted by the same reference numerals, so detailed descriptions thereof are omitted and only different parts will be described.

In the configuration illustrated in FIG. 19, a guide rib 180 is provided at an outer surface of the belt 43. The guide rib 180 is an example of a second guide. The guide rib 180 is provided at a position at which at least a part thereof overlaps with the guide convex portion 161R in the direction of the roller rotation axis Z. In addition, at least a part of the guide rib 180 opposes the guide convex portion 161R. Further, the shortest gap D1 between the guide convex portion 161R and outer surface of the belt 43 is smaller than a length D5 over which the guide rib 180 protrudes from the belt 43 in the radial direction of the support roller 42.

With the above configuration, when the belt 43 starts to deviate toward the widthwise center of the support roller 42, the guide rib 180 is sandwiched between the guide convex portion 161R and flange section 52R. At this time, the belt 43 receives, from the guide convex portion 161R, a restoring force that pushes back the guide rib 180 toward the right end of the support roller 42 as a horizontal component of a reaction force of the guide convex portion 161R, thereby preventing a state where the belt 43 is kept to deviate from the support roller 42.

Fourteenth Embodiment

Figure 20:
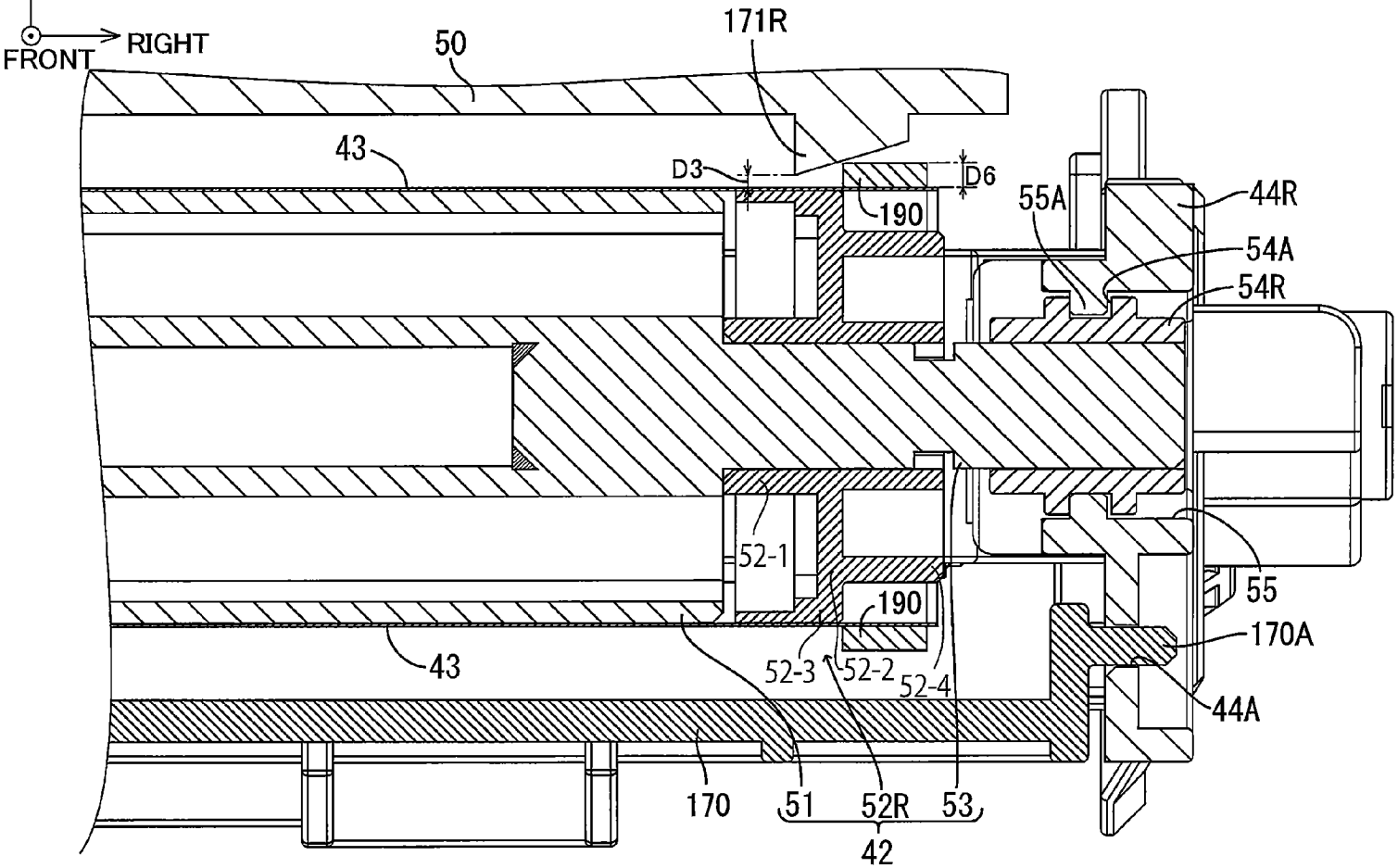
FIG. 20 is a cross-sectional view of a right portion of a belt unit according to a fourteenth embodiment.

FIG. 20 illustrates a fourteenth embodiment. This embodiment differs from the embodiment illustrated in FIG. 18 in the configuration of the guide rib, and other configurations are the same as those in the embodiment of FIG. 18. Thus, the same parts in the subsequent drawings are denoted by the same reference numerals, so detailed descriptions thereof are omitted and only different parts will be described.

In the configuration illustrated in FIG. 20, a guide rib 190 is provided at an outer surface side of the belt 43. The guide rib 190 is an example of a second guide. The guide rib 190 is provided at a position at which at least a part thereof overlaps with the guide convex portion 171R when viewed in the direction of the roller rotation axis Z. In addition, at least a part of the guide rib 190 opposes the guide convex portion 171R. Further, the shortest gap D3 between the guide convex portion 171R and outer surface of the belt 43 is smaller than a length D6 over which the guide rib 190 protrudes from the belt 43 in the radial direction of the support roller 42.

With the above configuration, when the belt 43 starts to deviate to the widthwise center of the support roller 42, the guide rib 190 is sandwiched between the guide convex portion 171R and the flange section 52R. At this time, the belt 43 receives, from the guide convex portion 171R, a restoring force that pushes back the guide rib 190 to the right end side of the support roller 42 as a horizontal component force of a reaction force of the guide convex portion 171R, thereby preventing a state where the belt 43 is kept to deviate from the support roller 42.

Fifteenth Embodiment

Figure 21:
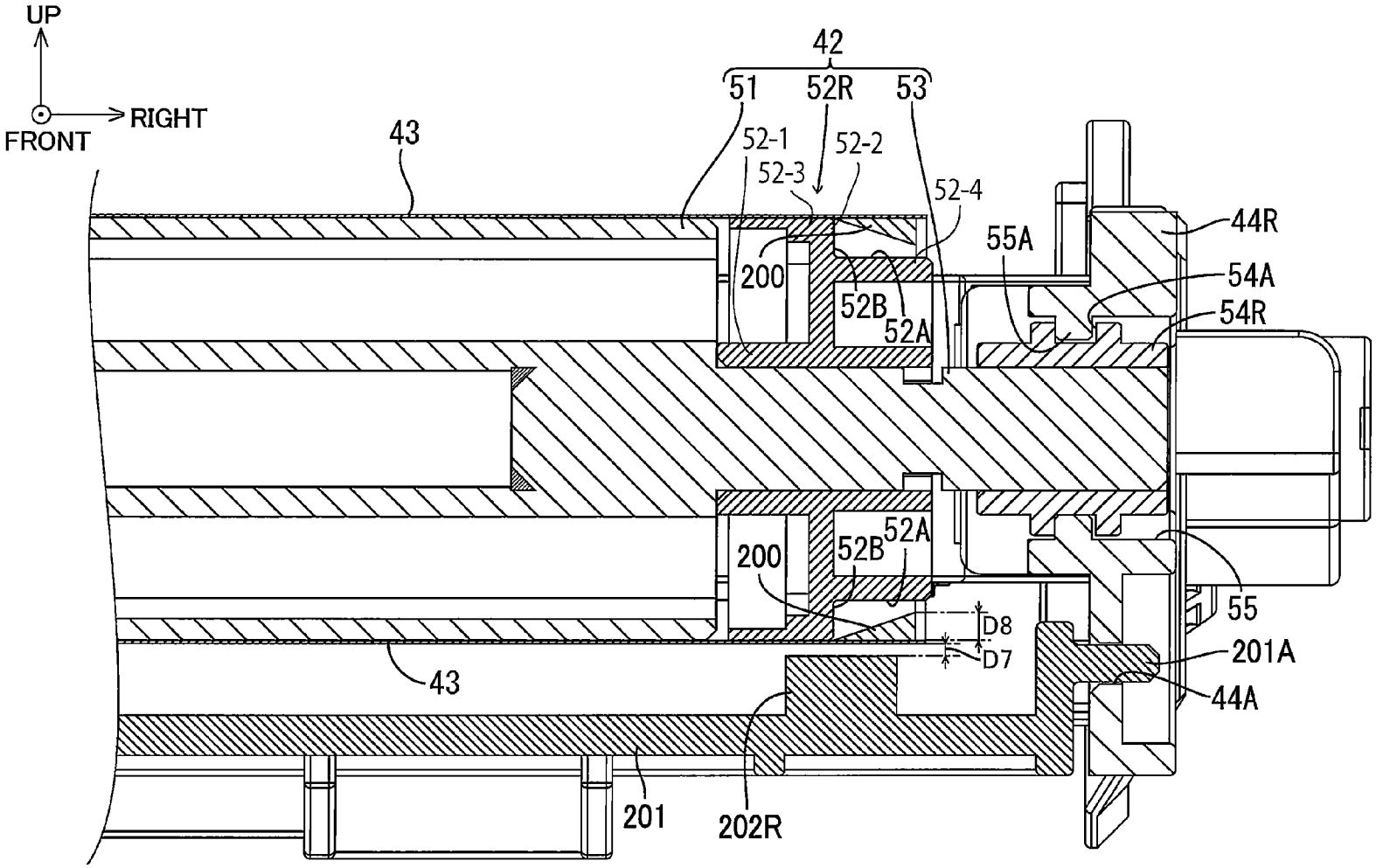
FIG. 21 is a cross-sectional view of a right portion of a belt unit according to a fifteenth embodiment.

FIG. 21 illustrates a fifteenth embodiment. This embodiment differs from the above embodiments in the configurations of the guide rib and regulation portion, and other configurations are the same as those in the above embodiments. Thus, the same parts in the subsequent drawings are denoted by the same reference numerals, so detailed descriptions thereof are omitted and only different parts will be described.

In the configuration illustrated in FIG. 21, a convex-shaped guide rib 200 is formed on a right end portion of the inner peripheral surface of the belt 43, i.e. on the support roller 42 side. The guide rib 200 is an example of a second guide. The guide rib 200 is engaged in the annular stepped guide portion 52A of the flange section 52R. A protruding length of the guide rib 200 from the belt 43 becomes smaller toward the center of the belt 43.

An underframe 201 includes a fixing convex portion 201A similar to the fixing protrusions 46A and has substantially the same shape as that of the bottom frame 46 illustrated in FIG. 12 except for the followings. That is, a guide convex portion 202R is integrally formed on an upper surface of the underframe 201. An upper surface of the guide convex portion 202R is substantially parallel to the outer surface of the belt 43, and the guide convex portion 202R has a width in the leftward/rightward direction, which is substantially the same as that of the guide rib 200. A gap D7 between an upper surface of the guide convex portion 202R and outer surface of the belt 43 is smaller than a length D8 over which the guide rib 200 and annular stepped guide portion 52A overlap with each other in the radial direction of the support roller 42.

With the above configuration, even when the guide rib 200 starts separating from the annular stepped guide portion 52A, the guide rib 200 is pushed back to the annular stepped guide portion 52A by the guide convex portion 202R, thereby preventing a state where the belt 43 is kept to deviate from the support roller 42.

While the description has been made in detail with reference to specific embodiments thereof, it would be apparent to those skilled in the art that various changes and modifications may be made therein without departing from the spirit and scope of the above described embodiments.

Various modifications are conceivable. For example, the image forming apparatus is not limited to a printer 1, but can be applied to a copying machine, a facsimile machine, and a multifunction device provided with a plurality of functions such as a printing function and reading function. Further, image forming apparatus other than an electro-photographic type apparatus, such as an ink jet printer is also available. Further, a monochromatic printer is also available in addition to the color printer.

Further, the belt unit may have a configuration in which the belt is mounted on one roller or not less than three rollers. Further, the belt is not limited to the conveying belt but may be an intermediate transfer belt or a photosensitive belt.

Further, the shape of the rotating member is not limited to cylindrical, but conical shape or a spherical shape is available. Further, the regulating portion need not have the rotary body or convex portion but may be realized only by the bottom frame 46. In the latter case, a gap between the upper surface of the bottom frame 46 and outer surface of the belt 43 is smaller than the length D2.

Further, the regulating portion such as the rotary body 61 can only be aligned with one of the guide rib 60 and the adjacent portion 52C in the direction of the roller rotation axis Z.

What is claimed is:

1. A belt unit comprising:

a roller extending in an axial direction and defining a radial direction perpendicular to the axial direction;

a first guide provided on a surface of the roller, the first guide being in a form of one of a convex shape and a concave shape;

a belt configured to be looped taut around the roller;

a second guide provided on an inner belt surface, the second guide being in a form of one of a concave shape and a convex shape, the first guide and the second guide being engaged with each other with an engagement depth in the radial direction;

a regulating portion opposite to an outer belt surface and providing a gap being smaller than the engagement depth, wherein the gap is a length between the regulating portion and the outer belt surface; and a plate covering at least part of the outer belt surface in the axial direction, wherein the regulating portion is a protruding portion that protrudes from and is integrally disposed on the plate.

2. The belt unit according to claim 1, wherein the regulating portion has a first portion aligned with the second guide in the radial direction.

3. The belt unit according to claim 2, wherein the surface of the roller has an adjacent part adjacent to the first guide in the axial direction; and wherein the regulating portion has a second portion aligned with the adjacent part in the radial direction.

4. The belt unit according to claim 1, wherein the regulating portion comprises a rotating member configured to rotate when contacting the belt.

5. The belt unit according to claim 4, wherein the regulating portion further comprises a support portion having a concave portion supporting the rotating member.

6. The belt unit according to claim 1, wherein the regulating portion comprises two rotating members configured to rotate when contacting the outer belt surface.

7. The belt unit according to claim 6, wherein the belt is movable in a moving direction; and wherein the two rotating members being arrayed in the axial direction and having rotating axes each inclined with respect to the axial direction, the rotating axes providing a distance therebetween gradually decreased in the moving direction.

8. An image forming apparatus comprising:

an image forming section configured to form an image using a coloring material; and the belt unit according to claim 1 configured to convey the image.

9. The image forming apparatus according to claim 1, further comprising a cleaning unit configured to clean the belt;

wherein the belt is an endless belt movable in a moving direction and the outer belt surface has a region ranging from the cleaning unit to the image forming section in the moving direction, the regulating portion opposite to the region.

10. A belt unit comprising:

a roller extending in an axial direction and defining a radial direction perpendicular to the axial direction, the roller having a center portion in the axial direction;

a first guide provided on a surface of the roller, the first guide being in a form of a concave shape;

a belt configured to be looped taut around the roller;

a second guide in a form of a convex shape configured to engage with the first guide with an engagement depth in the radial direction, the belt having a center belt portion in the axial direction; and a regulating portion opposite to an outer belt surface and having a portion aligned with the first guide in the radial direction, the regulating portion being profiled to provide a gap between the regulating portion and the outer belt surface in the radial direction such that the gap is gradually decreased toward the center belt portion in the axial direction, the gap having a minimum gap length smaller than the engagement depth.

11. The belt unit according to claim 10, wherein the regulating portion has an end surface opposite to the outer belt surface and inclined with respect to the axial direction.

12. The belt unit according to claim 10, wherein the regulating portion comprises a rotating member configured to rotate when contacting the belt.

13. The belt unit according to claim 10, wherein the roller has one end portion, and another end portion in the axial direction;

wherein the first guide comprises a pair of first guide members each provided on the surface of the belt and having a concave shape, one of the pair of first guide members being disposed close to the one end portion, and a remaining one of the pair of first guide members being disposed close to the another end portion;

wherein the second guide comprises a pair of second guide members each having a convex shape and configured to engage with corresponding one of the pair of first guide members, each one of the pair of first guide members and corresponding one of the pair of second guide members being engaged with each other; and wherein the regulating portion comprises a pair of regulating members, each being aligned with each one of the pair of first guide members in the radial direction respectively.

14. The belt unit according to claim 10, wherein the belt is an endless belt having a forward portion on which a sheet is configured to be conveyed, and a backward portion other than the forward portion, the regulating portion opposite to the backward portion.

15. The belt unit according to claim 10, further comprising an image forming section configured to form an image using a coloring material; and wherein the belt is configured to convey the image.

16. The belt unit according to claim 15, further comprising a cleaning unit configured to clean the belt;

wherein the belt is an endless belt and movable in a moving direction, the outer belt surface having a region ranging from the cleaning unit to the image forming section in the moving direction, the regulating portion opposite to the region.

17. The belt unit according to claim 10, wherein the surface of the roller has an adjacent part adjacent to the first guide in the axial direction, the regulating portion having a portion aligned with the adjacent part in the radial direction.

* * * * *